US010301770B2

(12) United States Patent
Koide et al.

(10) Patent No.: US 10,301,770 B2
(45) Date of Patent: May 28, 2019

(54) PROCESS FOR PRODUCING SHEET-SHAPED MATERIAL AND SHEET-SHAPED MATERIAL OBTAINED BY SAID PROCESS

(71) Applicant: TORAY INDUSTRIES, INC., Tokyo (JP)

(72) Inventors: Gen Koide, Otsu (JP); Shunichiro Nakai, Gifu (JP); Satoshi Yanagisawa, Gifu (JP); Makoto Nishimura, Otsu (JP); Takahiro Tsuchimoto, Gifu (JP)

(73) Assignee: TORAY INDUSTRIES, INC., Tokyo (JP)

( * ) Notice: Subject to any disclaimer, the term of this patent is extended or adjusted under 35 U.S.C. 154(b) by 534 days.

(21) Appl. No.: 14/427,744

(22) PCT Filed: Sep. 13, 2013

(86) PCT No.: PCT/JP2013/074833
§ 371 (c)(1),
(2) Date: Mar. 12, 2015

(87) PCT Pub. No.: WO2014/042241
PCT Pub. Date: Mar. 20, 2014

(65) Prior Publication Data

US 2015/0233050 A1 Aug. 20, 2015

(30) Foreign Application Priority Data

| | | |
|---|---|---|
| Sep. 14, 2012 | (JP) | 2012-203305 |
| Sep. 14, 2012 | (JP) | 2012-203441 |
| Sep. 14, 2012 | (JP) | 2012-203547 |
| Sep. 14, 2012 | (JP) | 2012-203603 |

(51) Int. Cl.

| | |
|---|---|
| ***D06N 3/00*** | (2006.01) |
| ***D06N 3/14*** | (2006.01) |
| ***D06M 11/05*** | (2006.01) |
| ***D06M 15/333*** | (2006.01) |
| ***D06M 15/564*** | (2006.01) |

(52) U.S. Cl.
CPC ..... *D06M 15/564* (2013.01); *D06N 3/0004* (2013.01); *D06N 3/0006* (2013.01); *D06N 3/0009* (2013.01); *D06N 3/0011* (2013.01); *D06N 3/0036* (2013.01); *D06N 3/0088* (2013.01); *D06N 3/14* (2013.01); *D06M 11/05* (2013.01); *D06M 15/333* (2013.01); *D06N 2209/105* (2013.01); *D06N 2211/063* (2013.01); *D06N 2211/106* (2013.01); *D06N 2211/14* (2013.01); *D06N 2211/24* (2013.01); *D06N 2211/26* (2013.01); *D06N 2211/28* (2013.01); *Y10T 442/20* (2015.04)

(58) Field of Classification Search
USPC ..... 442/339, 340, 351; 428/359, 361, 401, 428/364
See application file for complete search history.

(56) References Cited

U.S. PATENT DOCUMENTS

| | | | | |
|---|---|---|---|---|
| 3,914,501 A * | 10/1975 | Miller | D04H 1/4382 | 156/155 |
| 6,921,508 B2 * | 7/2005 | Latini | D06N 3/0004 | 264/172.13 |
| 2005/0079781 A1 * | 4/2005 | Tsujimoto | D04H 3/12 | 442/59 |

FOREIGN PATENT DOCUMENTS

| | | |
|---|---|---|
| CN | 1590635 | 3/2005 |
| CN | 101725052 | 6/2010 |
| CN | 102517919 | 6/2012 |
| CN | 102776602 | 11/2012 |
| EP | 1243691 | 9/2002 |
| EP | 1536056 | 6/2005 |
| EP | 2133463 | 12/2009 |
| JP | 62033885 | 2/1987 |
| JP | 05033256 | 2/1993 |
| JP | 2002030579 | 1/2002 |
| JP | 2002242083 | 8/2002 |
| JP | 2002294572 | 10/2002 |
| JP | 2003096676 | 4/2003 |
| JP | 2003213575 | 7/2003 |
| JP | 2013234409 | 11/2013 |

OTHER PUBLICATIONS

International Search Report dated Dec. 24, 2013 for International Application No. PCT/JP2013/074833.
International Preliminary Report on Patentability dated Mar. 17, 2015 for International Application No. PCT/JP2013/074833.
Chinese Office Action dated Nov. 4, 2015 for Chinese Application No. 201380047851.5.
Extended European Search Report for EP Application No. 13836539.0 dated May 6, 2016.

* cited by examiner

*Primary Examiner* — Lynda Salvatore
(74) *Attorney, Agent, or Firm* — Ratnerprestia

(57) ABSTRACT

Provided is an environmentally friendly process for producing a sheet-shaped material having both an elegant, napped appearance and a soft texture, which qualities have not been achieved concurrently, and also exhibiting good abrasion resistance. The process of the present invention for producing a sheet-shaped material includes the successive steps of (a) adding a polyvinyl alcohol having a degree of saponification of 98% or more and a degree of polymerization of 800 to 3,500 to a fibrous substrate in an amount of 0.1 to 50% by mass relative to the total mass of fibers in the fibrous substrate; (b) adding a waterborne polyurethane to the fibrous substrate with the added polyvinyl alcohol; and (c) removing the polyvinyl alcohol from the fibrous substrate with the added waterborne polyurethane.

12 Claims, No Drawings

PROCESS FOR PRODUCING SHEET-SHAPED MATERIAL AND SHEET-SHAPED MATERIAL OBTAINED BY SAID PROCESS

CROSS REFERENCE TO RELATED APPLICATIONS

This is the U.S. National Phase application of PCT International Application No. PCT/JP2013/074833, filed Sep. 13, 2013, and claims priority to Japanese Patent Application No. 2012-203305, filed Sep. 14, 2012, Japanese Patent Application No. 2012-203441, filed Sep. 14, 2012, Japanese Patent Application No. 2012-203547, filed Sep. 14, 2012, and Japanese Patent Application No. 2012-203603, filed Sep. 14, 2012, the disclosures of each of these applications being incorporated herein by reference in their entireties for all purposes.

FIELD OF THE INVENTION

The present invention relates to a process for producing a sheet-shaped material having both good softness and a high-quality appearance and exhibiting good abrasion resistance, the process using a waterborne polyurethane as a binder resin for the purpose of reducing the amount of the organic solvents used, thereby reducing the burden on the environment.

BACKGROUND OF THE INVENTION

Sheet-shaped materials comprised primarily of a fibrous substrate and polyurethane have excellent characteristics that cannot be found in natural leather, and are widely used in various applications. In particular, leather-like sheet-shaped materials using a polyester fibrous substrate have excellent light resistance, and thus have been increasingly applied to clothing, chair upholstery, automobile interior materials and other applications.

Such sheet-shaped materials are typically produced by wet coagulation process involving impregnating a fibrous substrate with a polyurethane solution in an organic solvent and then immersing the resulting fibrous substrate in a solvent that does not dissolve the polyurethane (i.e., water or a mixed solution of an organic solvent and water) to coagulate the polyurethane. The organic solvent used to dissolve the polyurethane is a water-miscible organic solvent such as N,N-dimethylformamide (DMF). There has been proposed, for example, a process comprising adding polyvinyl alcohol (hereinafter, also called "PVA") to a nonwoven fabric, impregnating the nonwoven fabric with a polyurethane solution in DMF, wet-coagulating the polyurethane in a 45% aqueous DMF solution, and removing the PVA in hot water (see Patent Literature 1). However, since organic solvents are typically highly harmful to human bodies and the environment, there has been a strong demand for a production process of a sheet-shaped material not using organic solvents.

In order to provide a specific solution to meet the demand, there has been proposed, for example, a process using a waterborne polyurethane (polyurethane dispersed in water) in place of a conventional polyurethane in an organic solvent. However, a sheet-shaped material produced by impregnating a waterborne polyurethane into a fibrous substrate has a hard texture. This problem is mainly caused by strong adhesion of the polyurethane to the fibers in the fibrous substrate. To solve the problem, there has been proposed a process which comprises the following steps as in a conventional production process using a polyurethane in an organic solvent: first adding PVA to a fibrous substrate for the purpose of partially suppressing the adhesion between the fibers and a polyurethane to be added later and thereby of forming voids between the fibers and the polyurethane, adding the polyurethane, and removing the PVA (see Patent Literature 2). However, since PVA is water soluble, when the fibrous substrate with added PVA is wetted with water, the PVA is dissolved away and lost in the water. Regarding this, the process in Patent Literature 2 involves the following steps in which the fibrous substrate is wetted with water: (i) the step of impregnating the fibrous substrate with a waterborne polyurethane and (ii) the step of ultra-fining the fibers with an aqueous alkali solution. In the latter step of ultra-fining the fibers, the dissolution of PVA is prevented by the addition of borax to the aqueous alkali solution. However, in the former impregnation step with the waterborne polyurethane, the dissolution of PVA in the waterborne polyurethane dispersion cannot be prevented because the PVA used (degree of saponification: 98%) has a low degree of polymerization of 500. If the PVA is dissolved away in the waterborne polyurethane dispersion, the adhesion of the polyurethane to the fibers cannot be stably controlled, resulting in a sheet-shaped material having a hard texture.

PATENT LITERATURE

Patent Literature 1: JP 2002-30579 A
Patent Literature 2: JP 2003-096676 A

SUMMARY OF THE INVENTION

An object of the present invention is to provide a process for producing a sheet-shaped material having both an elegant, napped appearance and a soft texture and exhibiting good abrasion resistance, the process using a reduced amount of organic solvents, thereby reducing the burden on the environment.

The process of the present invention for producing a sheet-shaped material comprises, according to an embodiment of this invention, the successive steps of:

(a) adding a PVA having a degree of saponification of 98% or more and a degree of polymerization of 800 to 3,500 to a fibrous substrate in an amount of 0.1 to 50% by mass relative to the total mass of fibers in the fibrous substrate;

(b) adding a waterborne polyurethane to the fibrous substrate with the added PVA; and (c) removing the PVA from the fibrous substrate with the added waterborne polyurethane.

According to a preferred embodiment of the process of the present invention for producing a sheet-shaped material, the fibrous substrate in the steps (a), (b) and (c) comprises, as its main constituent, microfibers having an average single fiber diameter of 0.3 to 7 μm or microfiber-generating fibers; wherein when the fibrous substrate comprises the microfibers as its main constituent, the step of generating the microfibers from the microfiber-generating fibers is performed before adding the polyvinyl alcohol; and wherein when the fibrous substrate comprises the microfiber-generating fibers as its main constituent, the step of generating the microfibers from the microfiber-generating fibers is performed after or concurrently with removing the polyvinyl alcohol following adding the waterborne polyurethane.

According to a preferred embodiment of the process of the present invention for producing a sheet-shaped material, the step of generating the microfibers is performed by treatment with an aqueous alkali solution.

According to a preferred embodiment of the process of the present invention for producing a sheet-shaped material, the fibrous substrate in the steps (a), (b) and (c) comprises, as its main constituent, microfibers having an average single fiber diameter of 0.3 to 7 μm, wherein, before the step (a), the step of generating the microfibers from microfiber-generating fibers contained in a fibrous substrate as its main constituent is performed.

According to a preferred embodiment of the process of the present invention for producing a sheet-shaped material, the fibrous substrate in the steps (a), (b) and (c) comprises, as its main constituent, microfibers having an average single fiber diameter of 0.3 to 7 μm, wherein, before the step (a), the steps of adding a waterborne polyurethane to a fibrous substrate comprising microfiber-generating fibers as its main constituent and of generating the microfibers from the microfiber-generating fibers in the fibrous substrate with the added waterborne polyurethane (the substrate with the polyurethane added for reinforcement) are performed.

According to a preferred embodiment of the process of the present invention for producing a sheet-shaped material, the fibrous substrate in the steps (a), (b) and (c) comprises microfiber-generating fibers as its main constituent, wherein, after the step (c), the step of generating microfibers having an average single fiber diameter of 0.3 to 7 μm from the microfiber-generating fibers contained in the fibrous substrate as its main constituent.

According to a preferred embodiment of the process of the present invention for producing a sheet-shaped material, the PVA has a tensile strength of 400 to 800 kg/cm$^2$.

According to a preferred embodiment of the process of the present invention for producing a sheet-shaped material, the fibrous substrate is prepared by entangling microfibers having an average single fiber diameter of 0.3 to 7 μm or microfiber-generating fibers with a woven fabric and/or a knitted fabric so as to be integrated together.

The sheet-shaped material obtained by the process of the present invention for producing a sheet-shaped material preferably has a density of 0.2 to 0.7 g/cm$^3$.

The production process of the present invention is environmentally friendly and yet provides a sheet-shaped material having both an elegant appearance and a soft texture, which qualities have not been achieved concurrently, and also exhibiting good abrasion resistance.

DETAILED DESCRIPTION OF EMBODIMENTS OF THE INVENTION

The process of the present invention for producing a sheet-shaped material comprises, according to one embodiment of the invention, the successive steps of:

(a) adding a PVA having a degree of saponification of 98% or more and a degree of polymerization of 800 to 3,500 to a fibrous substrate in an amount of 0.1 to 50% by mass relative to the total mass of fibers in the fibrous substrate;

(b) adding a waterborne polyurethane to the fibrous substrate with the added PVA; and (c) removing the PVA from the fibrous substrate with the added waterborne polyurethane.

In accordance with the process of an embodiment of the present invention for producing a sheet-shaped material, the steps (a), (b) and (c) are successively performed to first add a PVA to a fibrous substrate and then add a waterborne polyurethane to the fibrous substrate, thereby reducing the area where the polyurethane directly adheres to the fibers. Consequently, the force exerted by the polyurethane to grip the fibers will become smaller, and the resulting sheet-shaped material will have a soft texture. When the fibrous substrate with the added PVA is dried, the migration of the PVA occurs. That is, when the fibrous substrate to which an aqueous solution of the PVA has been added is dried by heating, the PVA in water migrates along with the migration of the water toward the surface and the PVA concentrates in the surface region of the fibrous substrate (migration phenomenon). As a result, more PVA adheres to the surface region of the fibrous substrate and less PVA adheres to the inside. Such migration of the PVA allows the waterborne polyurethane to be added later to mainly adhere to the inside of the fibrous substrate. Then, after the PVA is removed, large voids are formed between the fibers and the polyurethane in the surface region, where a large amount of the PVA once adhered. The sheet-shaped material with such voids, after napping treatment, can give elegant appearance with a napped surface on which the raised fibers are not bundled but uniformly separated.

According to a preferred embodiment of the process of the present invention for producing a sheet-shaped material, the fibrous substrate comprises, as its main constituent, microfibers having an average single fiber diameter of 0.3 to 7 μm or microfiber-generating fibers; wherein when the fibrous substrate comprises the microfibers as its main constituent, the step of generating the microfibers from the microfiber-generating fibers is performed before adding the PVA; and wherein when the fibrous substrate comprises the microfiber-generating fibers as its main constituent, the step of generating the microfibers from the microfiber-generating fibers is performed after or concurrently with removing the PVA following adding the waterborne polyurethane. When the step of generating the microfibers is performed before adding the PVA or after removing the PVA, i.e., in the absence of the PVA, the PVA is more ensured not to be dissolved away. The prevention of the dissolution of the PVA allows the added PVA to exhibit the intended effects of the present invention. Moreover, since there is no occurrence of contamination of the waterborne polyurethane dispersion with dissolved PVA and no occurrence of adherence of solidified PVA to the sheet-shaped material, the resulting sheet-shaped material will not develop a hard texture. When the step of generating the microfibers is performed after adding the waterborne polyurethane, there is no occurrence of contamination of the polyurethane with the PVA. Therefore, also in one embodiment in which the step of generating the microfibers is performed concurrently with removing the PVA, similar effects can also be achieved.

When the step of generating the microfibers (removal of a sea component) is performed before adding the PVA, the PVA is attached to the microfibers generated by ultra-fining, then the waterborne polyurethane is attached thereto, and the PVA is removed. This process reduces the area where the microfibers are gripped by the polyurethane, and thereby the texture of the sheet-shaped material is softened. On the other hand, when the removal of a sea component is performed after or concurrently with removing the PVA following adding the waterborne polyurethane, voids are formed between the polyurethane and the microfibers by the removal of the PVA and by the removal of the sea component. These voids further efficiently reduces the area where the microfibers are directly gripped by the polyurethane, and thereby the texture of the sheet-shaped material is softened. When the former case is compared with the latter case, the former has a larger adhesion area where the microfibers are gripped by the polyurethane. Therefore, in this case, even if the amount of the waterborne polyurethane adhering to the sheet-shaped material is small, the resulting sheet-shaped material can maintain physical properties such as abrasion resistance. In the latter case, the size of the voids formed between the microfibers and the polyurethane are larger, and thus the resulting sheet-shaped material can develop a softer texture. In cases where the removal of a sea component is performed before adding the PVA, a waterborne polyurethane may be added before the removal of the sea component for the purpose of reinforcement of the sheet-shaped material. This can reduce deformation of the sheet-shaped material during the removal of the sea component. As described above, the removal of a sea component can be performed at an appropriate timing depending on the intended characteristics of the sheet-shaped material to be obtained.

Preferably, the fibrous substrate used to produce the sheet-shaped material in the present invention is made from microfiber-generating fibers and is subjected to generation of microfibers so that the fibrous substrate comprises, as its main constituent, the microfibers generated from the microfiber-generating fibers. When microfiber-generating fibers are used in the present invention, the microfiber-generating fibers are preferably subjected to the step of ultra-fining to generate microfibers, which provides an elegant appearance on the surface of the sheet-shaped material.

The average single fiber diameter of the microfibers generated from the microfiber-generating fibers by the step of ultra-fining is 0.3 to 7 μm. When the average single fiber diameter is 7 μm or less, more preferably 6 μm or less, even more preferably 5 μm or less, the resulting sheet-shaped material will have excellent softness and excellent nap quality. When the average single fiber diameter is 0.3 μm or more, more preferably 0.7 μm or more, even more preferably 1 μm or more, the resulting sheet-shaped material will exhibit excellent chromogenic properties for dyeing, excellent separability of fibers aggregated into bundles during napping treatment by, for example, grinding with a sandpaper or the like, and excellent loosening properties.

The fibers used to produce the fibrous substrate in the present invention are not particularly limited, and the fibers may be any fibers made from thermoplastic resins capable of being subjected to melt spinning, including polyesters such as polyethylene terephthalate, polybutylene terephthalate, polytrimethylene terephthalate, and polylactic acid; polyamides such as 6-nylon and 66-nylon; acrylics; polyethylenes; polypropylenes; and thermoplastic celluloses. Among them, preferred are polyester fibers because of their strength, dimensional stability, and light resistance. Due to environmental concerns, the fibers are preferably made from recycled materials or plant-derived materials. The fibrous substrate may comprise mixed fibers made from different materials.

The microfiber-generating fibers may be (a) islands-in-the-sea fibers, which are prepared using two types of thermoplastic resins having different solvent solubilities as the sea and island components and which can generate microfibers from the island component through the dissolution and removal of the sea component with a solvent or the like; or (b) splitting composite fibers, which are prepared by alternately arranging two types of thermoplastic resins in radial segments or multi-layered segments in the cross-section and which can generate microfibers through splitting the fibers by peeling and separating the segments. Among these, the islands-in-the-sea fibers can give voids in an appropriate size between the island components, i.e., between the microfibers, through the removal of the sea component, and thus are preferred for achieving softness and good texture of the sheet-shaped material.

Examples of the islands-in-the-sea fibers include islands-in-the-sea composite fibers, which are prepared by spinning two types of alternately aligned components (sea and island components) from a spinneret for islands-in-the-sea composite spinning; and blended-spun fibers, which are prepared by blending two types of components (sea and island components) and spinning them into fibers. Preferred are islands-in-the-sea composite fibers because the fibers can generate microfibers having uniform fineness and sufficient length, which sufficient length contributes to the strength of the sheet-shaped material.

The island component of the islands-in-the-sea fibers is not particularly limited and may be any fibers made from thermoplastic resins capable of being subjected to melt spinning, including polyesters such as polyethylene terephthalate, polybutylene terephthalate, polytrimethylene terephthalate, and polylactic acid; polyamides such as 6-nylon and 66-nylon; acrylics; polyethylenes; polypropylenes; and thermoplastic celluloses. Among them, polyester fibers are preferred because of their strength, dimensional stability, and light resistance. Due to environmental concerns, the fibers are preferably made from recycled materials or plant-derived materials. The fibrous substrate may comprise mixed fibers made from different materials.

The island component of the islands-in-the-sea fibers may be the same as the fibers constituting the above fibrous substrate.

The ultra-fining treatment (removal of the sea component) of the islands-in-the-sea fibers can be performed by immersing the islands-in-the-sea fibers in a solvent and wringing out the solvent. When the sea component is made from polyethylene, polypropylene or polystyrene, the solvent for dissolving the sea component may be an organic solvent such as toluene and trichloroethylene. When the sea component is made from a copolymerized polyester or polylactic acid, the solvent may be an aqueous solution of alkali such as sodium hydroxide. When the sea component is made from a PVA, the solvent may be hot water. Due to environmental concerns regarding the process, the removal of the sea component is preferably performed with an aqueous solution of alkali such as sodium hydroxide or hot water.

The sea component of the islands-in-the-sea fibers is not particularly limited, and may be, for example, polyethylenes; polypropylenes; polystyrenes; copolymerized polyesters prepared by copolymerizing sodium sulfoisophthalate, polyethylene glycol, or the like and polylactic acid; or PVA. Among them, due to environmental concerns, preferred are copolymerized polyesters prepared by copolymerizing sodium sulfoisophthalate, polyethylene glycol, or the like and polylactic acid, because these polymers are alkali-degradable and can be degraded without any organic solvent. Also preferred is PVA because it is soluble in hot water.

The cross-sectional shape of the fibers constituting the fibrous substrate is not particularly limited, and may be a circular shape, an oval shape, a flat shape, a polygonal shape such as a triangular shape, or a modified cross-sectional shape such as fan and cross shapes.

In the present invention, the average single fiber diameter of the fibers constituting the fibrous substrate is preferably 0.3 to 20 μm. When the average single fiber diameter of the fibers is smaller, the resulting sheet-shaped material will have more excellent softness and more excellent nap quality. On the other hand, when the average single fiber diameter of the fibers is larger, the resulting sheet-shaped material will exhibit more excellent chromogenic properties for dyeing, more excellent separability of fibers aggregated into bundles during napping treatment by, for example, grinding with a sandpaper or the like, and more excellent loosening properties. The average single fiber diameter is thus more preferably 0.7 to 15 μm and particularly preferably 1 to 7 μm.

The fibrous substrate of the present invention may be a woven fabric, a knitted fabric, a nonwoven fabric, or the like. Among them, preferred is a nonwoven fabric because it gives a sheet-shaped material having a good surface appearance after napping treatment on the surface.

The nonwoven fabric may be a staple nonwoven fabric or a filament nonwoven fabric. The filament nonwoven fabric has a smaller amount of fibers which lie in the thickness direction of a sheet-shaped material and which is to forma nap by napping, as compared with a staple nonwoven fabric. A filament nonwoven fabric thus is likely to give a less dense nap, resulting in a poor surface appearance. Therefore preferred is a staple nonwoven fabric.

The fiber length of the staples of the staple nonwoven fabric is preferably 25 to 90 mm. When the fiber length is 25 mm or more, the fibers can be entangled to yield a sheet-shaped material having excellent abrasion resistance. When the fiber length is 90 mm or less, the fibers can yield a sheet-shaped material having excellent texture and quality. The fiber length is more preferably 30 to 80 mm.

The method for entangling the fibers or fiber bundles to yield a nonwoven fabric may be needle punching or water-jet punching.

In the present invention, when the fibrous substrate comprising microfibers is a nonwoven fabric, a preferred embodiment of the nonwoven fabric is a nonwoven fabric having structure in which bundles of microfibers (microfiber bundles) are entangled. The entangled bundles of microfibers improves the strength of the sheet-shaped material. Such a nonwoven fabric can be obtained by entangling microfiber-generating fibers and then generating microfibers therefrom.

When the nonwoven fabric is made from microfibers or bundles of microfibers, a woven fabric or a knitted fabric may be integrated inside the nonwoven fabric by entangling for the purpose of improving the strength and other properties. Examples of the woven fabric include plain woven fabrics, twill woven fabrics, and satin woven fabrics, and preferred is plain woven fabrics in view of the cost. Examples of the knitted fabric include circular knitted fabrics, tricot fabrics, and raschel fabrics. The fibers constituting such woven and knitted fabrics preferably have an average single fiber diameter of 0.3 to 20 μm.

In one embodiment of the present invention, the PVA to be added to the fibrous substrate has a degree of saponification of 98% or more and a degree of polymerization of 800 to 3,500. When the degree of saponification is 98% or more, the PVA does not dissolved away in the waterborne polyurethane dispersion during the addition of the waterborne polyurethane. If the PVA is dissolved away in the waterborne polyurethane dispersion, the PVA cannot exhibit a sufficient effect of protecting the surface of the nap-forming microfibers. In addition, if a waterborne polyurethane dispersion in which the PVA has been dissolved is added to the fibrous substrate, the PVA is incorporated into the polyurethane and the PVA then becomes difficult to be removed. Consequently, the adhesion between the polyurethane and the fibers cannot be stably controlled, resulting in a hard texture.

In general, the solubility of PVA in water varies with its degree of polymerization. If the PVA herein has a degree of polymerization of less than 800, the PVA is dissolved away in the waterborne polyurethane dispersion during the addition of the waterborne polyurethane. If the PVA has a degree of polymerization of more than 3,500, an aqueous solution of the PVA has a higher viscosity. As a result, when the fibrous substrate is impregnated with the aqueous PVA solution, the PVA cannot infiltrate the inside of the fibrous substrate.

In the present invention, the viscosity of an aqueous solution of 4% by mass of the PVA at 20° C. is preferably 10 to 50 mPa·s. When the viscosity is within the range, an appropriate migration structure is formed in the fibrous substrate at the time of drying, and the resulting sheet-shaped material will exhibit balanced physical properties including softness, surface appearance, and abrasion resistance. When the viscosity is 10 mPa·s or more, more preferably 15 mPa·s or more, an excessive-migration structure is prevented from being formed. When the viscosity is 50 mPa·s or less, more preferably 40 mPa·s or less, the PVA readily infiltrates the fibrous substrate.

In the present invention, the glass transition temperature of the PVA is preferably 70 to 100° C. When the glass transition temperature is 70° C. or higher, more preferably 75° C. or higher, the softening of the PVA during the drying step is prevented, and thereby the fibrous substrate can maintain dimensional stability and the resulting sheet-shaped material will not have a poor surface appearance. When the glass transition temperature is 100° C. or lower, more preferably 95° C. or lower, the fibrous substrate is prevented from becoming excessively hard and is thereby prevented from becoming difficult to undergo the subsequent steps.

In the present invention, the melting point of the PVA is preferably 200 to 250° C. When the melting point is 200° C. or higher, more preferably 210° C. or higher, the softening of the PVA during the drying step is prevented, and thereby the fibrous substrate can maintain dimensional stability and the resulting sheet-shaped material will not have a poor surface appearance. When the melting point is 250° C. or lower, more preferably 240° C. or lower, the fibrous substrate is prevented from becoming excessively hard and is thereby prevented from becoming difficult to undergo the subsequent steps.

In the present invention, the tensile strength of the PVA in the form of a film is preferably 400 to 800 kg/cm$^2$. When the tensile strength is 400 kg/cm$^2$ or more, more preferably 450 kg/cm$^2$ or more, deformation of the fibrous substrate while undergoing the subsequent steps is prevented, and the resulting sheet-shaped material will not have a poor surface appearance. When the tensile strength is 800 kg/cm$^2$ or less, more preferably 750 kg/cm$^2$ or less, the sheet with the added PVA is prevented from becoming excessively hard, and thereby the formation of wrinkles by buckling or other defects while undergoing the subsequent steps is prevented. The tensile strength herein is determined by using a film of the PVA with a thickness of 100 μm at a temperature of 20° C. and a humidity of 65%.

The amount of the PVA to be added to the fibrous substrate is 0.1 to 50% by mass and preferably 1 to 45% by mass relative to the total mass of the fibers in the fibrous substrate. When the amount of the PVA is 0.1% by mass or more, the resulting sheet-shaped material has good softness and texture. When the amount of the PVA is 50% by mass or less, the resulting sheet-shaped material has good processability and good physical properties including abrasion resistance.

In the present invention, the method for adding the PVA to the fibrous substrate is not particularly limited, and may be any method commonly used in the art. Preferred is a method involving dissolving the PVA in water, impregnating the fibrous substrate with the PVA solution, and heat-drying the substrate, so that the PVA can be uniformly added. If the drying temperature is too low, a longer drying time is required. On the other hand, if the drying temperature is too high, the PVA becomes completely insoluble and cannot be dissolved and removed in the subsequent step. Hence, the drying temperature is preferably 80 to 160° C., and more preferably 110 to 150° C. The drying time is usually 1 to 20 minutes, and is preferably 1 to 10 minutes and more preferably 1 to 5 minutes in view of the processability. In order to make the PVA relatively insoluble, heat treatment may be performed after the drying. The heating treatment is preferably performed at 80 to 180° C. By the heat treatment, insolubilization of the PVA occurs simultaneously with thermal degradation thereof, and thus the heating temperature is more preferably 100° C. to 160° C.

In a preferred embodiment of the present invention, a waterborne polyurethane is added to the fibrous substrate with the added PVA. In cases where a waterborne polyurethane is added before the sea component removal step, the purpose of this addition is to reinforce the fibrous substrate. Thus a waterborne polyurethane may be added to the fibrous substrate with no PVA.

Preferably, the waterborne polyurethane is added to the fibrous substrate with the added PVA so that the amount of the polyurethane contained in the fibrous substrate is 1 to 80% by mass relative to the total mass of the fibrous substrate. The main purpose of the addition of the polyurethane is to impart durability (especially abrasion resistance) to the end product. If the amount of the polyurethane contained in the substrate is too small, the resulting sheet-shaped material lacks sufficient physical properties, durability and other properties for practical use. Therefore, the amount is more preferably 2 to 50% by mass.

In cases where the fibrous substrate in the steps (a), (b) and (c) comprises, as its main constituent, microfibers having an average single fiber diameter of 0.3 to 7 μm and where, before the step (a), the steps of adding the waterborne polyurethane to a fibrous substrate comprising microfiber-generating fibers as its main constituent and of generating the microfibers from the microfiber-generating fibers in the fibrous substrate with the added waterborne polyurethane are performed, the waterborne polyurethane is added before and after the step of ultra-fining the fibers. The waterborne polyurethane used before and after the ultra-fining step may be the same or different types.

The waterborne polyurethane includes (I) forcibly emulsified polyurethanes, which have been forced to be dispersed and stabilized with use of a surfactant, and (II) self-emulsifying polyurethanes, which have hydrophilic structures in their molecular structures and are dispersed and then stabilized in water without use of any surfactant. Both types of polyurethanes can be used in the present invention.

The method for adding the waterborne polyurethane to the fibrous substrate is not particularly limited, but preferred is a method in which the waterborne polyurethane is impregnated into or applied to the fibrous substrate, then coagulated and heat-dried, because, by this method, the waterborne polyurethane is uniformly added.

In a preferred embodiment of the present invention, the polyurethane dispersion can be impregnated into and applied to the fibrous substrate, and the polyurethane can be coagulated by dry coagulation, wet-heat coagulation, wet coagulation, or any combination thereof.

The concentration of the polyurethane in the dispersion in water (the amount of the polyurethane dispersed in water) is preferably 10 to 50% by mass and more preferably 15 to 40% by mass in view of storage stability of the waterborne polyurethane dispersion.

The polyurethane dispersion used in the present invention may contain a water-soluble organic solvent in an amount of 40% by mass or less relative to the total amount of the polyurethane dispersion for the purpose of improving the storage stability of the polyurethane dispersion and the productivity of the sheet. The amount of the organic solvent is preferably 1% by mass or less in view of the production conditions for the sheet and the like.

The waterborne polyurethane dispersion used in the present invention preferably has heat-sensitive coagulation properties. When the waterborne polyurethane dispersion has heat-sensitive coagulation properties, the polyurethane can be added uniformly in the thickness direction of the fibrous substrate.

The term "heat-sensitive coagulation properties" herein refers to properties that, when the polyurethane dispersion is heated and reaches a certain temperature (heat-sensitive coagulation temperature), reduce the flowability of the polyurethane dispersion and then coagulate the polyurethane. In the production of the sheet-shaped material with the polyurethane added, the waterborne polyurethane is added to the fibrous substrate, then coagulated by dry coagulation, wet-heat coagulation, wet coagulation, or any combination thereof, and dried to give the fibrous substrate with the added polyurethane. In industrial production, a realistic method for coagulating a waterborne polyurethane not exhibiting heat-sensitive coagulation properties is dry coagulation. By this method, the polyurethane migrates toward and concentrates in the surface region of the fibrous substrate, and such a migration phenomenon is likely to harden the texture of the resulting sheet-shaped material with the polyurethane. In such a case, the migration can be prevented by controlling the viscosity of the waterborne polyurethane dispersion by the addition of a thickener. In cases where a waterborne polyurethane exhibiting heat-sensitive coagulation properties is used, the migration can also be prevented by the addition of a thickener before the subsequent dry coagulation.

The heat-sensitive coagulation temperature of the waterborne polyurethane is preferably 40 to 90° C. When the heat-sensitive coagulation temperature is 40° C. or higher, the polyurethane dispersion has good storage stability and the adhesion of the polyurethane to the machines during operation is prevented. When the heat-sensitive coagulation temperature is 90° C. or lower, the migration of the polyurethane in the fibrous substrate is prevented.

In one embodiment of the present invention, in order to achieve the above heat-sensitive coagulation temperature, a heat-sensitive coagulant may be added to the polyurethane dispersion, as appropriate. Examples of the heat-sensitive coagulant include inorganic salts such as sodium sulfate, magnesium sulfate, calcium sulfate, and calcium chloride; and radical initiators such as sodium persulfate, potassium persulfate, ammonium persulfate, azobisisobutyronitrile, and benzoyl peroxide.

The wet-heat coagulation temperature is preferably equal to or higher than the heat-sensitive coagulation temperature of the polyurethane and is preferably 40 to 200° C. When the wet-heat coagulation temperature is 40° C. or higher, more preferably 80° C. or higher, the polyurethane can coagulate in a shorter period of time and the migration phenomenon is more efficiently prevented. When the wet-heat coagulation temperature is 200° C. or lower, more preferably 160° C. or lower, thermal degradation of the polyurethane and of the PVA is prevented.

The wet coagulation temperature is preferably equal to or higher than the heat-sensitive coagulation temperature of the polyurethane and is preferably 40 to 100° C. When the temperature for wet coagulation in hot water is 40° C. or higher, more preferably 80° C. or higher, the polyurethane can coagulate in a shorter period of time and the migration phenomenon is more efficiently prevented.

The dry coagulation temperature and the drying temperature are preferably 80 to 180° C. When the dry coagulation temperature and the drying temperature are 80° C. or higher, more preferably 90° C. or higher, the productivity is excellent. When the dry coagulation temperature and the drying temperature are 180° C. or lower, more preferably 160° C. or lower, thermal degradation of the polyurethane and of the PVA is prevented.

The polyurethane used in the present invention is preferably obtained by reaction of a polymer diol and an organic diisocyanate with a chain extender.

Examples of the polymer diol include, but are not particularly limited to, polycarbonate diols, polyester diols, polyether diols, silicone diols, and fluorine diols, and copolymers obtained by combining them. In view of hydrolysis resistance, preferred are polycarbonate diols and polyether diols. In view of light resistance and heat resistance, preferred are polycarbonate diols and polyester diols. In view of the balance among hydrolysis resistance, heat resistance and light resistance, more preferred are polycarbonate diols and polyester diols, and particularly preferred are polycarbonate diols.

The polycarbonate diols can be produced by, for example, transesterification of an alkylene glycol and a carbonate or reaction of phosgene or a chloroformate with an alkylene glycol.

Examples of the alkylene glycol include, but are not particularly limited to, linear alkylene glycols such as ethylene glycol, propylene glycol, 1,4-butanediol, 1,5-pentanediol, 1,6-hexanediol, 1,9-nonanediol, and 1,10-decanediol; branched alkylene glycols such as neopentyl glycol, 3-methyl-1,5-pentanediol, 2,4-diethyl-1,5-pentanediol, and 2-methyl-1,8-octanediol; alicyclic diols such as 1,4-cyclohexanediol; aromatic diols such as bisphenol A; glycerin; trimethylolpropane; and pentaerythritol. The polycarbonate diol may be either a polycarbonate diol obtained from a single type of alkylene glycol or a copolymerized polycarbonate diol obtained from two or more types of alkylene glycols.

The polyester diols are exemplified by polyester diols obtained by condensation of various low molecular weight polyols and polybasic acids.

Examples of the low molecular weight polyols include, but are not particularly limited to, ethylene glycol, 1,2-propylene glycol, 1,3-propylene glycol, 1,3-butanediol, 1,4-butanediol, 2,2-dimethyl-1,3-propanediol, 1,6-hexanediol, 3-methyl-1,5-pentanediol, 1,8-octanediol, diethylene glycol, triethylene glycol, dipropylene glycol, tripropylene glycol, cyclohexane-1,4-diol, and cyclohexane-1,4-dimethanol. These polyols may be used singly or in combination of two or more of them. Adducts prepared by adding various alkylene oxides to bisphenol A are also usable.

Examples of the polybasic acids include, but are not particularly limited to, succinic acid, maleic acid, adipic acid, glutaric acid, pimelic acid, suberic acid, azelaic acid, sebacic acid, dodecanedicarboxylic acid, phthalic acid, isophthalic acid, terephthalic acid, and hexahydroisophthalic acid. These acids may be used singly or in combination of two or more of them.

Examples of the polyether diols include, but are not particularly limited to, polyethylene glycol, polypropylene glycol, polytetramethylene glycol, and copolymerized diols obtained by combining them.

The number average molecular weight of the polymer diol used in the present invention is preferably 500 to 4,000. When the number average molecular weight is 500 or more, more preferably 1,500 or more, the texture of the sheet-shaped material is prevented from becoming excessively hard. When the number average molecular weight is 4,000 or less, more preferably 3,000 or less, the polyurethane can maintain its strength.

Examples of the organic diisocyanate include, but are not particularly limited to, aliphatic diisocyanates such as hexamethylene diisocyanate, dicyclohexylmethane diisocyanate, isophorone diisocyanate, and xylylene diisocyanate; and aromatic diisocyanates such as diphenylmethane diisocyanate and tolylene diisocyanate. These diisocyanates may be used in combination. Among them, in view of light resistance, preferred are aliphatic diisocyanates such as hexamethylene diisocyanate, dicyclohexylmethane diisocyanate, and isophorone diisocyanate.

Examples of the chain extender include, but are not particularly limited to, amine chain extenders such as ethylenediamine and methylenebisaniline; and diol chain extenders such as ethylene glycol. Polyamines prepared by reacting a polyisocyanate with water may also be used as the chain extender.

The polyurethane, if desired, may be used in combination with a crosslinking agent for the purpose of improving water resistance, abrasion resistance, hydrolysis resistance, and other characteristics. The crosslinking agent may be an external crosslinking agent, which is added to the polyurethane as a third component, or an internal crosslinking agent, which previously introduces reaction points into the molecular structure of the polyurethane to form crosslinked structure. In the present invention, preferred is an internal crosslinking agent because it can form crosslinking points uniformly throughout the molecular structure of the polyurethane and alleviates the reduction in softness.

The crosslinking agent may be a compound having an isocyanate group, an oxazoline group, a carbodiimide group, an epoxy group, a melamine resin, a silanol group, or the like. Excessive crosslinking is likely to harden the polyurethane, resulting in a sheet-shaped material with a hard texture. Therefore preferred is a crosslinking agent having a silanol group in view of the balance between reactivity and softness.

The polyurethane used in the present invention preferably has a hydrophilic group in its molecular structure. When a hydrophilic group exists in the molecular structure of the polyurethane, the polyurethane, when dispersed in water, will have higher dispersibility and stability.

The hydrophilic group may be any hydrophilic groups including cationic groups such as quaternary amine groups; anionic groups such as a sulfonate group and a carboxylate group; nonionic groups such as a polyethylene glycol group; combinations of a cationic group and a nonionic group; and combinations of an anionic group and a nonionic group. Among them, particularly preferred are the nonionic hydrophilic groups, which are free from concerns of yellowing by light or harmful effects by a neutralizer.

In cases where the polyurethane has an anionic hydrophilic group, a neutralizer is required. For example, when the neutralizer used is a tertiary amine such as ammonia, triethylamine, triethanolamine, triisopropanolamine, trimethylamine, and dimethylethanolamine, the amine is volatilized by heating during the sheet production or drying and is released outside the system. In order to prevent the emission to the atmosphere or the deterioration of working environment, a device for recovering the volatilized amine is required to be installed. If the amine is not volatilized by the heating but remains in a sheet-shaped material as the end product, the amine may be released in the environment when, for example, the product is burned. On the other hand, in cases where the polyurethane has a nonionic hydrophilic group, no neutralizer is required and thus the installment of an amine-recovering device is also not required. In addition, there is no need for concerns about a remaining amine in the sheet-shaped material. Therefore, the polyurethane having a nonionic hydrophilic group is preferred.

In cases where the neutralizer for the anionic hydrophilic group is required and the neutralizer is a hydroxide of an alkali metal or an alkaline earth metal, such as sodium hydroxide, potassium hydroxide, and calcium hydroxide, the polyurethane wetted with water shows a shift to alkaline pH. On the other hand, since the polyurethane having a nonionic hydrophilic group requires no neutralizer, there is no need for concerns about the deterioration of the polyurethane by hydrolysis.

The waterborne polyurethane used in the present invention, if desired, may contain various additives, including pigments such as carbon black; flame retardants such as phosphoric flame retardants, halogen flame retardants, silicone flame retardants, and inorganic flame retardants; antioxidants such as phenol antioxidants, sulfur-containing antioxidants, and phosphorus-containing antioxidants; ultraviolet absorbers such as benzotriazole ultraviolet absorbers, benzophenone ultraviolet absorbers, salicylate ultraviolet absorbers, cyanoacrylate ultraviolet absorbers, and oxalic acid anilide ultraviolet absorbers; light stabilizers such as hindered amine light stabilizers and benzoate light stabilizers; hydrolysis inhibitors such as polycarbodiimide; plasticizers; antistatic agents; surfactants; thickeners; softening agents; water repellents; coagulation modifiers; dyes; antiseptics; antimicrobials; deodorants; fillers such as cellulose particles and microballoons; and inorganic particles such as silica particles and titanium oxide particles. The waterborne polyurethane may also contain inorganic foaming agents such as sodium hydrogen carbonate and organic foaming agents such as 2,2'-azobis[2-methyl-N-(2-hydroxyethyl)propionamide] in order to form large voids between the fibers and the polyurethane.

The amount of the polyurethane contained in the sheet-shaped material of the present invention is preferably 1 to 80% by mass relative to the total mass of the sheet-shaped material. When the amount of the polyurethane contained in the sheet-shaped material is 1% by mass or more, more preferably 5% by mass or more, the sheet-shaped material will have high strength and the fibers are prevented from falling off from the sheet-shaped material. When the amount of the polyurethane contained in the sheet-shaped material is 80% by mass or less, more preferably 70% by mass or less, the texture of the sheet-shaped material is prevented from becoming excessively hard and the sheet-shaped material will have a nap of good quality. In cases where the waterborne polyurethane for reinforcement is added before the step of ultra-fining the fibers in the present invention, the said amount of the polyurethane contained in the sheet-shaped material relative to total mass of the sheet-shaped material is preferably the total amount of the polyurethane added in the process of the present invention.

In one embodiment in which the polyurethane is added for reinforcement, preferably the waterborne polyurethane is added to the fibrous substrate before the ultra-fining of the fibers so that the amount of the polyurethane contained in the fibrous substrate is 1 to 30% by mass relative to the total mass of the fibrous substrate. However, the main purpose of this addition of the polyurethane is to reinforce the fibrous substrate, and if the amount of the polyurethane contained in the fibrous substrate is excessively large, the texture of the resulting sheet-shaped material becomes too hard. Therefore, the amount is more preferably 2 to 20% by mass.

The fibrous substrate with the waterborne polyurethane added for reinforcement is then subjected to ultra-fining treatment (removal of the sea component) by which microfibers are generated from microfiber-generating fibers. The ultra-fining treatment (removal of the sea component) of the islands-in-the-sea fibers can be performed by immersing the islands-in-the-sea fibers in a solvent and wringing out the solvent. When the sea component is made from polyethylene, polypropylene, or polystyrene, the solvent for dissolving the sea component may be an organic solvent such as toluene and trichloroethylene. When the sea component is made from a copolymerized polyester or polylactic acid, the solvent may be an aqueous solution of alkali such as sodium hydroxide. When the sea component is made from a PVA, the solvent may be hot water. Due to environmental concerns regarding the process, the removal of the sea component is preferably performed with an aqueous solution of alkali such as sodium hydroxide or hot water.

In a preferred embodiment of the present invention, the PVA is removed from the sheet with the added polyurethane, thereby giving a soft sheet-shaped material. The method for removing the PVA is not particularly limited, but in a preferred embodiment, the PVA is dissolved and removed by, for example, immersing the sheet in hot water at 60 to 100° C., and wringing out the water from the sheet with a mangle or the like. Incases where the PVA is added to a fibrous substrate comprising microfiber-generating fibers as its main constituent, and the polyurethane is added thereto and the PVA is removed from the sheet with the added polyurethane, the step of generating microfibers from the microfiber-generating fibers may be performed concurrently with removing the PVA.

The process of the present invention for producing a sheet-shaped material may comprise, after at least the addition of the waterborne polyurethane to the fibrous substrate with the PVA added is performed, the step of cutting the fibrous substrate in half thickness-wise. As described above, in the step of adding the PVA, the PVA migrates toward the surface, and thus a large amount of the PVA adheres in the surface region of the fibrous substrate, whereas a small amount of the PVA adheres to the inside of the fibrous substrate. Subsequently the waterborne polyurethane is added and the fibrous substrate is cut in half thickness-wise to give a sheet-shaped material having a structure in which a small amount of the waterborne polyurethane adheres to the side to which a large amount of the PVA has adhered, whereas a large amount of the waterborne polyurethane adheres to the side to which a small amount of the PVA has adhered. In cases where the side to which a large amount of the PVA once adhered (i.e., the side to which a small amount of the waterborne polyurethane has adhered) is used as a nap face of the sheet-shaped material, the previous presence of the large amount of the PVA allows the formation of large voids between the polyurethane and the nap-forming microfibers, such large voids gives the freedom of movement to the nap-forming fibers, and as a result the sheet-shaped material will have soft surface texture, good appearance quality and soft-touch texture. On the other hand, in cases where the side to which a small amount of the PVA once adhered (i.e., the side to which a large amount of the waterborne polyurethane has adhered) is used as a nap face of the sheet-shaped material, the nap-forming fibers are strongly gripped by the polyurethane, which provides high-quality appearance with a short nap with more density and also provides good abrasion resistance. When the process comprises the step of cutting the sheet in half thickness-wise, the production efficiency is also improved.

At least one face of the sheet-shaped material may be subjected to napping treatment to raise a nap on the surface. The napping method is not particularly limited, and may be any conventional napping method in the art, such as buffing with a sandpaper or the like. An excessively short nap is unlikely to provide an elegant appearance, whereas an excessively long nap is likely to cause pilling. The length of the nap is thus preferably 0.2 to 1 mm.

In one embodiment of the present invention, before the napping treatment, silicone or the like may be added as a lubricant to the sheet-shaped material with the added polyurethane. The addition of a lubricant is preferred because it facilitates napping by surface grinding and provides the surface with excellent quality. An antistatic agent may also be added before the napping treatment. The addition of an antistatic agent is preferred because the dust generated from the sheet-shaped material by grinding is unlikely to deposit on the sandpaper.

In one embodiment of the present invention, the sheet-shaped material can be dyed. The dyeing can be performed by various methods commonly used in the art. Preferred is a method using a jet dyeing machine because, at the same time of dyeing, the sheet-shaped material is softened by kneading.

The dyeing temperature varies with the type of the fibers but is preferably 80 to 150° C. When the dyeing temperature is 80° C. or higher, more preferably 110° C. or higher, the attachment of dye to the fibers is efficiently performed. When the dyeing temperature is 150° C. or lower, more preferably 130° C. or lower, deterioration of the polyurethane is prevented.

The dye used in the present invention is not particularly limited as long as the dye is appropriately selected depending on the type of the fibers constituting the fibrous substrate. For example, when the fibers are polyester fibers, a disperse dye can be used. When the fibers are polyamide fibers, an acid dye, a metal complex dye, or a combination thereof may be used. In cases where the sheet-shaped material is dyed with a disperse dye, the sheet-shaped material may be subjected to reduction cleaning after the dyeing.

In a preferred embodiment, a dyeing aid is used during the dyeing. When a dyeing aid is used, uniform dyeing is achieved and reproduction of color is improved. Simultaneously with the dyeing or after the dyeing, finishing treatment can be performed using a fabric softener such as silicone, an antistatic agent, a water repellent, a flame retardant, a light stabilizer, an antimicrobial agent, or other finishing agents.

The density of the thus obtained sheet-shaped material of the present invention is preferably 0.2 to 0.7 g/cm$^3$. When the density is 0.2 g/cm$^3$ or more, more preferably 0.3 g/cm$^3$ or more, the surface is provided with density and high quality appearance. When the density is 0.7 g/cm$^3$ or less, more preferably 0.6 g/cm$^3$ or less, the texture of the sheet-shaped material is prevented from becoming excessively hard.

EXAMPLES

The process of embodiments of the present invention for producing a sheet-shaped material will be described in further detail with reference to examples, but the present invention is not limited to these examples. Various modifications can be made within the technical idea of the present invention by a person skilled in the art.

Evaluation Methods (1) Viscosity of Aqueous PVA Solution

In accordance with 3.11.1 Rotational viscometer method specified in JIS K6726 (1994) Testing methods for polyvinyl alcohol, the viscosity of an aqueous solution of 4% by mass of a PVA was determined at 20° C.

(2) Tensile Strength of PVA

A dispersion of 10% by mass of a PVA in water was cast into a polyethylene tray with a size of 5 cm×10 cm×1 cm. The dispersion was air-dried at 25° C. for 8 hours, and then heat-treated in a hot-air drier at 120° C. for 2 hours to give a dried film of the PVA with a thickness of 100 μm. The tensile strength of the dried film of the PVA was determined with a tensile tester in accordance with Method A (strip method) specified in JIS L1096 (2010) 8.14.1.

(3) Average Single Fiber Diameter

An average single fiber diameter was determined as follows. A photograph of the surface of a fibrous substrate or a sheet-shaped material was taken in a scanning electron microscope (SEM) at a magnification of 2,000. The diameters of randomly selected 100 fibers were measured, and the average was calculated to determine the average single fiber diameter.

In cases where the fibers constituting the fibrous substrate or the sheet-shaped material had a modified cross section, the diameter of the circumcircle of the modified cross section was measured as a single fiber diameter. In cases where fibers with a circular cross section were mixed with fibers with a modified cross section, or where fibers with greatly varying single fiber diameters were mixed, 100 fibers were selected so that the ratio of each type of fibers is equal to the actual existence ratio, and an average single fiber diameter was determined. In cases where a woven fabric or a knitted fabric was inserted into the fibrous substrate for the purpose of reinforcement, the fibers in the woven fabric or knitted fabric for reinforcement were excluded from the sampling for the determination of the average single fiber diameter.

(4) Bending Stiffness of Sheet-Shaped Material

In accordance with Method A (45° cantilever method) specified in JIS L1096 (2010) 8.21.1, 2 cm×15 cm test pieces long in the longitudinal direction or long in the transverse direction were cut out from the sheet (5 pieces from each direction), and each of the test pieces was placed on a horizontal platform with a 45° sloped surface and were slid. Once the free end of the test piece (the midpoint of the short side) touches the sloped surface, the length of the overhang was measured by the scale. The average of the values of five test pieces was calculated as bending stiffness.

(5) Surface Appearance of Sheet-Shaped Material

The surface appearance of a sheet-shaped material was evaluated by 20 panelists including 10 healthy adult males and 10 healthy adult females. Visual evaluation and sensory evaluation were performed and scored based on the following criteria with 5 grades. The grade which had the largest number of the panelists was taken as the grade for the surface appearance of the sheet-shaped material. Grades 3 to 5 were regarded as good surface appearance.

Grade 5: A uniform nap of the fibers were observed, the fibers were well separated, and the appearance was good.

Grade 4: the material was evaluated as between Grade 5 and Grade 3.

Grade 3: some of the fibers were not well separated, but the fibers were napped and the appearance was rather good.

Grade 2: the material was evaluated as between Grade 3 and Grade 1.

Grade 1: the fibers were very poorly separated throughout the whole surface or the napped fibers had a long length, and the appearance was poor.

(6) Evaluation of Abrasion Resistance of Sheet-Shaped Material

Nylon fibers being made of nylon 6 and having a diameter of 0.4 mm were cut perpendicularly to the longitudinal direction of the fibers into a length of 11 mm, and 100 fibers were aligned and bundled. Next, 97 bundles were arranged so that six concentric circles were formed inside a circle of a diameter of 110 mm (one bundle was placed at the center, six bundles were arranged centering around it to form a circle with a diameter of 17 mm, 13 bundles were arranged centering around it to form a circle with a diameter of 37 mm, 19 bundles were arranged centering around it to form a circle with a diameter of 55 mm, 26 bundles were arranged centering around it to form a circle with a diameter of 74 mm, and 32 bundles were arranged centering around it to form a circle with a diameter of 90 mm; in each circle, the bundles were arranged at equal intervals). The arranged bundles were used as a circular brush (the number of nylon yarns was 9,700 in total). A circular sample (diameter: 45 mm) was taken from a sheet-shaped material and the surface was abraded with the circular brush under the conditions of a load of 8 pounds (about 3,629 g), a rotation speed of 65 rpm, and a rotation time of 50 times. The change in the mass before and after the abrasion was determined, and the average of five samples was calculated as abrasion loss.

Example 1-1

Nonwoven Fabric as Fibrous Substrate

A polyethylene terephthalate copolymerized with 8 mol % of sodium 5-sulfoisophthalate was used as the sea component, and a polyethylene terephthalate was used as the island component. The sea and island components were used at a ratio of 45%:55% by mass to give islands-in-the-sea composite fibers with 36 islands per filament and an average single fiber diameter of 17 μm. The obtained islands-in-the-sea composite fibers were cut into a length of 51 mm to prepare staples. The staples were subjected to carding and cross lapping to form a fibrous web. The fibrous web was needle punched to give a nonwoven fabric. The thus obtained nonwoven fabric was shrunk by being immersed in hot water at a temperature of 98° C. for 2 minutes and was dried at a temperature of 100° C. for 5 minutes to give a nonwoven fabric as a fibrous substrate.

Ultra-Fining of Fibers (Removal of Sea Component)

The nonwoven fabric as a fibrous substrate was immersed in a 10 g/L aqueous sodium hydroxide solution at 95° C. for 30 minutes for the removal of the sea component from the islands-in-the-sea composite fibers to give a sea component-removed sheet. The average single fiber diameter of the fibers on the surface of the sea component-removed sheet was 3

Preparation of PVA Solution

A PVA (NM-14 produced by The Nippon Synthetic Chemical Industry Co., Ltd.) having a degree of saponification of 99% and a degree of polymerization of 1,400 was used to prepare an aqueous solution having a solid content of 10% by mass and the solution was used as a PVA solution.

Addition of PVA

The sea component-removed sheet was impregnated with the PVA solution, and heated and dried at a temperature of 140° C. for 10 minutes to give a sheet to which the PVA was attached in an amount of 10% by mass relative to the total mass of the fibers in the sea component-removed sheet.

Preparation of Polyurethane Dispersion

Polyhexamethylene carbonate was used as a polyol and dicyclohexylmethane diisocyanate was used as an isocyanate to give a self-emulsifying polycarbonate polyurethane liquid. To the self-emulsifying polycarbonate polyurethane liquid was added 2 parts by mass of ammonium persulfate (APS) as a heat-sensitive coagulant relative to 100 parts by mass of the solid content of the polyurethane liquid. Water was then added to adjust the overall solid content to 20% by mass to give a waterborne polyurethane dispersion. The heat-sensitive coagulation temperature was 72° C.

Addition of Polyurethane

The sea component-removed sheet with the added PVA was impregnated with the polyurethane dispersion. The sheet was treated in a wet-heat atmosphere at a temperature of 100° C. for 5 minutes, then dried with hot air at a drying temperature of 120° C. for 5 minutes, and dry-heated at a temperature of 150° C. for 2 minutes to give a sheet to which the polyurethane was attached in an amount of 30% by mass relative to the total mass of the fibers in the nonwoven fabric.

Removal of PVA

The sheet with the added polyurethane was immersed in hot water at 95° C. for 10 minutes to give a sheet from which the added PVA was removed.

Cutting in Half, Napping, Dyeing, Reduction Cleaning

The PVA-removed sheet was cut in half thickness-wise. The surfaces opposite to the cut surfaces were subjected to napping treatment by grinding with a 240-mesh abrasive belt. The sheet was then dyed with a disperse dye by using a circular dyeing machine and subjected to reduction cleaning to give a sheet-shaped material. The obtained sheet-shaped material had a good surface appearance, a soft texture, and good abrasion resistance.

Example 1-2

Plain Woven Fabric as Fibrous Substrate

A polyethylene terephthalate yarn of 84 dtex and 36 filaments was used as warp and weft and woven into a plain woven fabric having a warp density of 123 yarns/2.54 cm and a weft density of 98 yarns/2.54 cm, and the woven fabric was used as a fibrous substrate.

Preparation of PVA Solution

The same PVA solution as in Example 1-1 was used.

Addition of PVA

The woven fabric was impregnated with the same PVA solution as in Example 1-1, and heated and dried at a temperature of 140° C. for 10 minutes to give a sheet to which the PVA was attached in an amount of 20% by mass relative to the total mass of the fibers in the woven fabric.

Preparation of Polyurethane Dispersion

The same polyurethane dispersion as in Example 1-1 was used.

Addition of Polyurethane

The woven fabric with the added PVA was impregnated with the polyurethane dispersion. The fabric was treated in a wet-heat atmosphere at a temperature of 100° C. for 5 minutes, then dried with hot air at a drying temperature of 120° C. for 5 minutes, and dry-heated at a temperature of 150° C. for 2 minutes to give a sheet to which the polyurethane was attached in an amount of 10% by mass relative to the total mass of the fibers in the woven fabric.

Removal of PVA

The sheet with the added polyurethane was immersed in hot water at 95° C. for 10 minutes to give a sheet from which the added PVA was removed.

Napping, Dyeing, Reduction Cleaning

The surface of the PVA-removed sheet was subjected to napping treatment by grinding with a 320-mesh abrasive belt. The sheet was then dyed with a disperse dye by using a circular dyeing machine and subjected to reduction cleaning to give a sheet-shaped material. The obtained sheet-shaped material had a good surface appearance, a soft texture, and good abrasion resistance.

Example 1-3

Nonwoven Fabric as Fibrous Substrate

The same nonwoven fabric as in Example 1-1 was used as a fibrous substrate.

Ultra-Fining of Fibers (Removal of Sea Component)

In the same manner as in Example 1-1, a sea component-removed sheet was obtained from the nonwoven fabric as a fibrous substrate.

Preparation of PVA Solution

A PVA (NM-11 produced by The Nippon Synthetic Chemical Industry Co., Ltd.) having a degree of saponification of 99% and a degree of polymerization of 1,100 was used to prepare an aqueous solution having a solid content of 10% by mass and the solution was used as a PVA solution.

Addition of PVA

The sea component-removed sheet was impregnated with the PVA solution, and heated and dried at a temperature of 140° C. for 10 minutes to give a sheet to which the PVA was attached in an amount of 15% by mass relative to the total mass of the fibers in the sea component-removed sheet.

Preparation of Polyurethane Dispersion

The same waterborne polyurethane dispersion as in Example 1-1 was used.

Addition of Polyurethane

In the same manner as in Example 1-1, a sheet to which the polyurethane was attached in an amount of 30% by mass relative to the total mass of the fibers in the nonwoven fabric was obtained.

Removal of PVA

In the same manner as in Example 1-1, a sheet from which the added PVA was removed was obtained.

Cutting in Half, Napping, Dyeing, Reduction Cleaning

In the same manner as in Example 1-1, a sheet-shaped material was obtained. The obtained sheet-shaped material had a good surface appearance, a soft texture, and good abrasion resistance.

Example 1-4

Nonwoven Fabric as Fibrous Substrate

The same nonwoven fabric as in Example 1-1 was used as a fibrous substrate.

Ultra-Fining of Fibers (Removal of Sea Component)

In the same manner as in Example 1-1, a sea component-removed sheet was obtained from the nonwoven fabric as a fibrous substrate.

Preparation of PVA Solution

A PVA (NH-26 produced by The Nippon Synthetic Chemical Industry Co., Ltd.) having a degree of saponification of 99% and a degree of polymerization of 2,600 was used to prepare an aqueous solution having a solid content of 10% by mass and the solution was used as a PVA solution.

Addition of PVA

The sea component-removed sheet was impregnated with the PVA solution, and heated and dried at a temperature of 140° C. for 10 minutes to give a sheet to which the PVA was attached in an amount of 5% by mass relative to the total mass of the fibers in the sea component-removed sheet.

Preparation of Polyurethane Dispersion

The same waterborne polyurethane dispersion as in Example 1-1 was used.

Addition of Polyurethane

In the same manner as in Example 1-1, a sheet to which the polyurethane was attached in an amount of 30% by mass relative to the total mass of the fibers in the nonwoven fabric was obtained.

Removal of PVA

In the same manner as in Example 1-1, a sheet from which the added PVA was removed was obtained.

Cutting in Half, Napping, Dyeing, Reduction Cleaning

In the same manner as in Example 1-1, a sheet-shaped material was obtained. The obtained sheet-shaped material had a good surface appearance, a soft texture, and good abrasion resistance.

Example 1-5

Nonwoven Fabric as Fibrous Substrate

A polyethylene terephthalate copolymerized with 8 mol % of sodium 5-sulfoisophthalate was used as the sea component, and a polyethylene terephthalate was used as the island component. The sea and island components were used at a ratio of 20%:80% by mass to give islands-in-the-sea composite fibers with 16 islands per filament and an average single fiber diameter of 30 μm. The obtained islands-in-the-sea composite fibers were cut into a length of 51 mm to prepare staples. The staples were subjected to carding and cross lapping to form a fibrous web. The fibrous web was needle punched to give a nonwoven fabric. The thus obtained nonwoven fabric was shrunk by being immersed in hot water at a temperature of 98° C. for 2 minutes and was dried at a temperature of 100° C. for 5 minutes to give a nonwoven fabric as a fibrous substrate.

Ultra-Fining of Fibers (Removal of Sea Component)

The nonwoven fabric as a fibrous substrate was processed in the same manner as in Example 1-1 for the removal of the sea component from the islands-in-the-sea composite fibers to give a sea component-removed sheet. The average single fiber diameter of the fibers on the surface of the sea component-removed sheet was 4.4 μm.

Preparation of PVA Solution

The same PVA solution as in Example 1-1 was used.

Addition of PVA

In the same manner as in Example 1-1, a sheet with the PVA added was obtained.

Preparation of Polyurethane Dispersion

The same waterborne polyurethane dispersion as in Example 1-1 was used.

Addition of Polyurethane

In the same manner as in Example 1-1, a sheet with the polyurethane added was obtained.

Removal of PVA

In the same manner as in Example 1-1, a PVA-removed sheet was obtained.

Cutting in Half, Napping, Dyeing, Reduction Cleaning

In the same manner as in Example 1-1, a sheet-shaped material was obtained. The obtained sheet-shaped material had a good surface appearance, a soft texture, and good abrasion resistance.

Example 1-6

Nonwoven Fabric as Fibrous Substrate

The same nonwoven fabric as in Example 1-1 was used as a fibrous substrate.

Ultra-Fining of Fibers (Removal of Sea Component)

In the same manner as in Example 1-1, a sea component-removed sheet was obtained from the nonwoven fabric as a fibrous substrate.

Preparation of PVA Solution

The same PVA solution as in Example 1-1 was used.

Addition of PVA

The sea component-removed sheet was processed with the same PVA solution as in Example 1-1 in the same manner as in Example except that the amount of the PVA attached to the sea component-removed sheet was adjusted by controlling the degree of wringing after the impregnation, to give a sheet to which the PVA was attached in an amount of 20% by mass relative to the total mass of the fibers in the sea component-removed sheet.

Preparation of Polyurethane Dispersion

The same waterborne polyurethane dispersion as in Example 1-1 was used.

Addition of Polyurethane

In the same manner as in Example 1-1, a sheet with the polyurethane added was obtained.

Removal of PVA

In the same manner as in Example 1-1, a PVA-removed sheet was obtained.

Cutting in Half, Napping, Dyeing, Reduction Cleaning

In the same manner as in Example 1-1, a sheet-shaped material was obtained. The obtained sheet-shaped material had a good surface appearance, a soft texture, and good abrasion resistance.

Example 1-7

Nonwoven Fabric as Fibrous Substrate

A polyethylene terephthalate copolymerized with 8 mol % of sodium 5-sulfoisophthalate was used as the sea component, and a polyethylene terephthalate was used as the island component. The sea and island components were used at a ratio of 20%:80% by mass to give islands-in-the-sea composite fibers with 16 islands per filament and an average single fiber diameter of 30 μm. The obtained islands-in-the-sea composite fibers were cut into a length of 51 mm to prepare staples. The staples were subjected to carding and cross lapping to form a fibrous web. On each side of the web, a plain woven fabric using a PET hard twist yarn of 84 dtex and 72 filaments with a twist of 2,000 T/m was stacked, and the fibrous web and the plain woven fabrics were needle punched together to give a nonwoven fabric. The thus obtained nonwoven fabric was shrunk by being immersed in hot water at a temperature of 98° C. for 2 minutes and was dried at a temperature of 100° C. for 5 minutes to give a nonwoven fabric as a fibrous substrate.

Ultra-Fining of Fibers (Removal of Sea Component)

The nonwoven fabric as a fibrous substrate was processed in the same manner as in Example 1-1 for the removal of the sea component from the islands-in-the-sea composite fibers to give a sea component-removed sheet. The average single fiber diameter of the fibers on the surface of the sea component-removed sheet was 4.4 μm.

Preparation of PVA Solution

The same PVA solution as in Example 1-1 was used.

Addition of PVA

In the same manner as in Example 1-1, a sheet with the PVA added was obtained.

Preparation of Polyurethane Dispersion

The same waterborne polyurethane dispersion as in Example 1-1 was used.

Addition of Polyurethane

In the same manner as in Example 1-1, a sheet with the polyurethane added was obtained.

Removal of PVA

In the same manner as in Example 1-1, a PVA-removed sheet was obtained.

Cutting in Half, Napping, Dyeing, Reduction Cleaning

In the same manner as in Example 1-1, a sheet-shaped material was obtained. The obtained sheet-shaped material had a good surface appearance, a soft texture, and good abrasion resistance.

Example 1-8

Nonwoven Fabric as Fibrous Substrate

The same nonwoven fabric as in Example 1-1 was used as a fibrous substrate.

Ultra-Fining of Fibers (Removal of Sea Component)

In the same manner as in Example 1-1, a sea component-removed sheet was obtained from the nonwoven fabric as a fibrous substrate.

Preparation of PVA Solution

A PVA (PVA110 produced by Kuraray Co., Ltd.) having a degree of saponification of 99% and a degree of polymerization of 1,000 was used to prepare an aqueous solution having a solid content of 10% by mass and the solution was used as a PVA solution.

Addition of PVA

The sea component-removed sheet was impregnated with the PVA solution, and heated and dried at a temperature of 140° C. for 10 minutes to give a sheet to which the PVA was attached in an amount of 15% by mass relative to the total mass of the fibers in the sea component-removed sheet.

Preparation of Polyurethane Dispersion

The same waterborne polyurethane dispersion as in Example 1-1 was used.

Addition of Polyurethane

In the same manner as in Example 1-1, a sheet to which the polyurethane was attached in an amount of 30% by mass relative to the total weight of the fibers in the nonwoven fabric was obtained.

Removal of PVA

In the same manner as in Example 1-1, a sheet from which the added PVA was removed was obtained.

Cutting in Half, Napping, Dyeing, Reduction Cleaning

In the same manner as in Example 1-1, a sheet-shaped material was obtained. The obtained sheet-shaped material had a good surface appearance, a soft texture, and good abrasion resistance.

Example 1-9

Nonwoven Fabric as Fibrous Substrate

The same nonwoven fabric as in Example 1-1 was used as a fibrous substrate.

Ultra-Fining of Fibers (Removal of Sea Component)

In the same manner as in Example 1-1, a sea component-removed sheet was obtained from the nonwoven fabric as a fibrous substrate.

Preparation of PVA Solution

A PVA (NM-14 produced by The Nippon Synthetic Chemical Industry Co., Ltd.) having a degree of saponification of 99% and a degree of polymerization of 1,400 was used to prepare an aqueous solution having a solid content of 10% by mass and the solution was used as a PVA solution.

Addition of PVA

The sea component-removed sheet was impregnated with the PVA solution, and heated and dried at a temperature of 140° C. for 10 minutes to give a sheet to which the PVA was attached in an amount of 10% by mass relative to the total mass of the fibers in the sea component-removed sheet.

Preparation of Polyurethane Dispersion

Polyhexamethylene carbonate was used as a polyol and dicyclohexylmethane diisocyanate was used as an isocyanate to give a self-emulsifying polycarbonate polyurethane liquid. To the self-emulsifying polycarbonate polyurethane liquid was added 10 parts by mass of a thickener (SN-THICKENER 612 produced by San Nopco Limited) relative to 100 parts by mass of the solid content of the polyurethane liquid. Water was then added to adjust the overall polyurethane solid content to 20% by mass to give a waterborne polyurethane dispersion.

Addition of Polyurethane

The sea component-removed sheet with the added PVA was impregnated with the polyurethane dispersion. The sheet was dried with hot air at a drying temperature of 120° C. for 8 minutes, and dry-heated at a temperature of 150° C. for 2 minutes to give a sheet to which the polyurethane was attached in an amount of 30% by mass relative to the total mass of the fibers in the nonwoven fabric.

Removal of PVA

In the same manner as in Example 1-1, a sheet from which the added PVA was removed was obtained.

Cutting in Half, Napping, Dyeing, Reduction Cleaning

In the same manner as in Example 1-1, a sheet-shaped material was obtained. The obtained sheet-shaped material had a good surface appearance, a soft texture, and good abrasion resistance.

Comparative Example 1-1

Nonwoven Fabric as Fibrous Substrate

The same nonwoven fabric as in Example 1-1 was used as a fibrous substrate.

Ultra-Fining of Fibers (Removal of Sea Component)

In the same manner as in Example 1-1, a sea component-removed sheet was obtained from the nonwoven fabric as a fibrous substrate.

Preparation of PVA Solution

A PVA (GL-05 produced by The Nippon Synthetic Chemical Industry Co., Ltd.) having a degree of saponification of 87% and a degree of polymerization of 500 was used to prepare an aqueous solution having a solid content of 10% by mass and the solution was used as a PVA solution.

Addition of PVA

The sea component-removed sheet was processed in the same manner as in Example 1-1 to give a sheet to which the PVA was attached in an amount of 10% by mass relative to the total mass of the fibers in the sea component-removed sheet.

Preparation of Polyurethane Dispersion

The same waterborne polyurethane dispersion as in Example 1-1 was used.

Addition of Polyurethane

In the same manner as in Example 1-1, a sheet to which the polyurethane was attached in an amount of 30% by mass relative to the total mass of the fibers in the nonwoven fabric was obtained.

Removal of PVA

In the same manner as in Example 1-1, a sheet from which the added PVA was removed was obtained.

Cutting in Half, Napping, Dyeing, Reduction Cleaning

In the same manner as in Example 1-1, a sheet-shaped material was obtained. On the obtained sheet-shaped material, the polyurethane was not uniformly attached due to partial dissolution of the PVA into the waterborne polyurethane dispersion. As a result, the sheet-shaped material had a poor surface appearance with poor separability of the fibers and with no dense nap and had a hard texture.

Comparative Example 1-2

Nonwoven Fabric as Fibrous Substrate

The same nonwoven fabric as in Example 1-1 was used as a fibrous substrate.

Ultra-Fining of Fibers (Removal of Sea Component)

In the same manner as in Example 1-1, a sea component-removed sheet was obtained from the nonwoven fabric as a fibrous substrate.

Preparation of PVA Solution

A PVA (NL-05 produced by The Nippon Synthetic Chemical Industry Co., Ltd.) having a degree of saponification of 99% and a degree of polymerization of 500 was used to prepare an aqueous solution having a solid content of 10% by mass and the solution was used as a PVA solution.

Addition of PVA

The sea component-removed sheet was processed in the same manner as in Example 1-1 to give a sheet to which the PVA was attached in an amount of 10% by mass relative to the total mass of the fibers in the sea component-removed sheet.

Preparation of Polyurethane Dispersion

The same waterborne polyurethane dispersion as in Example 1-1 was used.

Addition of Polyurethane

In the same manner as in Example 1-1, a sheet to which the polyurethane was attached in an amount of 30% by mass relative to the total mass of the fibers in the nonwoven fabric was obtained.

Removal of PVA

In the same manner as in Example 1-1, a sheet from which the added PVA was removed was obtained.

Cutting in Half, Napping, Dyeing, Reduction Cleaning

In the same manner as in Example 1-1, a sheet-shaped material was obtained. On the obtained sheet-shaped material, the polyurethane was not uniformly attached due to partial dissolution of the PVA in the waterborne polyurethane dispersion. As a result, the sheet-shaped material had a poor surface appearance with poor separability of the fibers and with no dense nap and had a hard texture.

Comparative Example 1-3

Nonwoven Fabric as Fibrous Substrate

The same nonwoven fabric as in Example 1-1 was used as a fibrous substrate.

Ultra-Fining of Fibers (Removal of Sea Component)

In the same manner as in Example 1-1, a sea component-removed sheet was obtained from the nonwoven fabric as a fibrous substrate. Preparation of PVA Solution The same PVA solution as in Example 1-1 was used.

Addition of PVA

The sea component-removed sheet was processed in the same manner as in Example 1-1 except that the amount of the PVA attached to the sea component-removed sheet was adjusted by controlling the degree of wringing after the impregnation, to give a sheet to which the PVA was attached in an amount of 55% by mass relative to the total mass of the fibers in the sea component-removed sheet.

Preparation of Polyurethane Dispersion

The same waterborne polyurethane dispersion as in Example 1-1 was used.

Addition of Polyurethane

In the same manner as in Example 1-1, a sheet to which the polyurethane was attached in an amount of 30% by mass relative to the total mass of the fibers in the nonwoven fabric was obtained.

Removal of PVA

In the same manner as in Example 1-1, a sheet from which the added PVA was removed was obtained.

Cutting in Half, Napping, Dyeing, Reduction Cleaning

In the same manner as in Example 1-1, a sheet-shaped material was obtained. The obtained sheet-shaped material had a soft texture. However, the excess amount of the PVA prevented the polyurethane from sufficiently gripping the fibers. As a result, the sheet-shaped material had a poor surface appearance with an excessively long nap and had poor abrasion resistance.

Comparative Example 1-4

A sheet-shaped material was produced in the same manner as in Example 1-1 except that no PVA solution was prepared and that no PVA was added or removed. The obtained sheet-shaped material had a hard texture and had a poor surface appearance without a nap.

Table 1 shows the evaluation results of the sheet-shaped materials obtained in Examples 1-1 to 1-9 and Comparative Examples 1-1 to 1-4.

The sheet-shaped materials obtained in Examples 1-1 to 1-9 had a good surface appearance, a soft texture, and good abrasion resistance. In contrast, most of the sheet-shaped materials obtained in Comparative Examples 1-1 to 1-4 had a poor surface appearance and a hard texture.

Example 2-1

Nonwoven Fabric as Fibrous Substrate

A polyethylene terephthalate copolymerized with 8 mol % of sodium 5-sulfoisophthalate was used as the sea component, and a polyethylene terephthalate was used as the island component. The sea and island components were used at a ratio of 45%:55% by mass to give islands-in-the-sea composite fibers with 36 islands per filament and an average single fiber diameter of 17 μm. The obtained islands-in-the-sea composite fibers were cut into a length of 51 mm to prepare staples. The staples were subjected to carding and cross lapping to form a fibrous web. The fibrous web was needle punched to give a nonwoven fabric. The thus obtained nonwoven fabric was shrunk by being immersed in hot water at a temperature of 98° C. for 2 minutes and was dried at a temperature of 100° C. for 5 minutes to give a nonwoven fabric as a fibrous substrate.

Preparation of PVA Solution

A PVA (NM-14 produced by The Nippon Synthetic Chemical Industry Co., Ltd.) having a degree of saponification of 99% and a degree of polymerization of 1,400 was used to prepare an aqueous solution having a solid content of 10% by mass and the solution was used as a PVA solution.

Addition of PVA

The nonwoven fabric as a fibrous substrate was impregnated with the PVA solution, and heated and dried at a temperature of 140° C. for 10 minutes to give a sheet to which the PVA was attached in an amount of 10% by mass relative to the total mass of the island component in the islands-in-the-sea fibers of the nonwoven fabric.

Preparation of Polyurethane Dispersion

Polyhexamethylene carbonate was used as a polyol and dicyclohexylmethane diisocyanate was used as an isocyanate to give a self-emulsifying polycarbonate polyurethane

TABLE 1

| | Fibrous substrate | Polyvinyl alcohol (PVA) | | | | | | Amount of | Sheet-shaped material | | | |
|---|---|---|---|---|---|---|---|---|---|---|---|---|
| Examples | Average single fiber diameter μm | Degree of saponification % | Degree of polymerization — | Viscosity mPa · s | Tg ° C. | Melting point ° C. | Tensile strength of film kg/cm$^2$ | attached PVA % by mass | Sheet density g/cm$^3$ | Texture mm | Abrasion resistance mg | Surface appearance Grade |
| Example 1-1 | 3 | 99 | 1400 | 22 | 85 | 230 | 550 | 10 | 0.4 | 50 | 22 | 5 |
| Example 1-2 | — (woven fabric) | 99 | 1400 | 22 | 85 | 230 | 550 | 20 | 0.3 | 40 | 30 | 4 |
| Example 1-3 | 3 | 99 | 1100 | 14 | 80 | 210 | 480 | 15 | 0.4 | 45 | 20 | 5 |
| Example 1-4 | 3 | 99 | 2600 | 64 | 88 | 235 | 600 | 5 | 0.2 | 74 | 13 | 4 |
| Example 1-5 | 4.4 | 99 | 1400 | 22 | 85 | 230 | 550 | 10 | 0.45 | 50 | 24 | 5 |
| Example 1-6 | 3 | 99 | 1400 | 22 | 85 | 230 | 550 | 20 | 0.3 | 40 | 30 | 4 |
| Example 1-7 | 4.4 | 99 | 1400 | 22 | 85 | 230 | 550 | 10 | 0.4 | 52 | 22 | 5 |
| Example 1-8 | 3 | 99 | 1000 | 11 | 80 | 210 | 480 | 15 | 0.4 | 43 | 19 | 5 |
| Example 1-9 | 3 | 99 | 1400 | 22 | 85 | 230 | 550 | 10 | 0.4 | 85 | 35 | 4 |
| Comparative Example 1-1 | 3 | 87 | 500 | 5 | 58 | 180 | 330 | 10 | 0.3 | 140 | 32 | 2 |
| Comparative Example 1-2 | 3 | 99 | 500 | 5 | 83 | 225 | 520 | 10 | 0.4 | 150 | 26 | 2 |
| Comparative Example 1-3 | 3 | 99 | 1400 | 22 | 85 | 230 | 550 | 55 | 0.15 | 15 | 80 | 1 |
| Comparative Example 1-4 | 3 | — | — | — | — | — | — | 0 | 0.4 | 190 | 10 | 1 |

liquid. To the self-emulsifying polycarbonate polyurethane liquid was added 2 parts by mass of ammonium persulfate (APS) as a heat-sensitive coagulant relative to 100 parts by mass of the solid content of the polyurethane liquid. Water was then added to adjust the overall solid content to 20% by mass to give a waterborne polyurethane dispersion. The heat-sensitive coagulation temperature was 72° C.

Addition of Polyurethane

The sheet with the added PVA was impregnated with the polyurethane dispersion. The sheet was treated in a wet-heat atmosphere at a temperature of 100° C. for 5 minutes, then dried with hot air at a drying temperature of 120° C. for 5 minutes, and dry-heated at a temperature of 150° C. for 2 minutes to give a sheet to which the polyurethane was attached in an amount of 30% by mass relative to the total mass of the island component in the nonwoven fabric.

Removal of PVA

The sheet with the added polyurethane was immersed in hot water at 95° C. for 10 minutes to give a sheet from which the added PVA was removed.

Ultra-Fining of Fibers (Removal of Sea Component)

The PVA-removed sheet was immersed in a 10 g/L aqueous sodium hydroxide solution at 95° C. for 30 minutes for the removal of the sea component from the islands-in-the-sea composite fibers to give a sea component-removed sheet. The average single fiber diameter of the fibers on the surface of the sea component-removed sheet was 3 μm.

Cutting in Half, Napping, Dyeing, Reduction Cleaning

The sea component-removed sheet was cut in half thickness-wise. The surfaces opposite to the cut surfaces were subjected to napping treatment by grinding with a 240-mesh abrasive belt. The sheet was then dyed with a disperse dye by using a circular dyeing machine and subjected to reduction cleaning to give a sheet-shaped material. The obtained sheet-shaped material had a good surface appearance, a soft texture, and good abrasion resistance.

Example 2-2

Nonwoven Fabric as Fibrous Substrate

A polyethylene terephthalate copolymerized with 8 mol % of sodium 5-sulfoisophthalate was used as the sea component, and a polyethylene terephthalate was used as the island component. The sea and island components were used at a ratio of 20%:80% by mass to give islands-in-the-sea composite fibers with 16 islands per filament and an average single fiber diameter of 30 μm. The obtained islands-in-the-sea composite fibers were cut into a length of 51 mm to prepare staples. The staples were subjected to carding and cross lapping to form a fibrous web. The fibrous web was needle punched to give a nonwoven fabric. The thus obtained nonwoven fabric was shrunk by being immersed in hot water at a temperature of 98° C. for 2 minutes and was dried at a temperature of 100° C. for 5 minutes to give a nonwoven fabric as a fibrous substrate.

Preparation of PVA Solution

The same PVA solution as in Example 2-1 was used.

Addition of PVA

In the same manner as in Example 2-1, a sheet with the PVA added was obtained.

Preparation of Polyurethane Dispersion

The same waterborne polyurethane dispersion as in Example 2-1 was used.

Addition of Polyurethane

In the same manner as in Example 2-1, a sheet with the polyurethane added was obtained.

Removal of PVA

In the same manner as in Example 2-1, a PVA-removed sheet was obtained.

Ultra-Fining of Fibers (Removal of Sea Component)

The PVA-removed sheet was subjected to ultra-fining of the fibers in the same manner as in Example 2-1 for the removal of the sea component from the islands-in-the-sea composite fibers to give a sea component-removed sheet. The average single fiber diameter of the fibers on the surface of the sea component removed sheet was 4.4 μm.

Cutting in Half, Napping, Dyeing, Reduction Cleaning

In the same manner as in Example 2-1, a sheet-shaped material was obtained. The obtained sheet-shaped material had a good surface appearance, a soft texture, and good abrasion resistance.

Example 2-3

Nonwoven Fabric as Fibrous Substrate

The same nonwoven fabric as in Example 2-1 was used as a fibrous substrate.

Preparation of PVA Solution

The same PVA solution as in Example 2-1 was used.

Addition of PVA

The nonwoven fabric as a fibrous substrate was processed with the same PVA solution as in Example 2-1 in the same manner as in Example 2-1 except that the amount of the PVA attached to the nonwoven fabric was adjusted by controlling the degree of wringing after the impregnation, to give a sheet to which the PVA was attached in an amount of 20% by mass relative to the total mass of the island component in the islands-in-the-sea fibers in the nonwoven fabric.

Preparation of Polyurethane Dispersion

The same waterborne polyurethane dispersion as in Example 2-1 was used.

Addition of Polyurethane

In the same manner as in Example 2-1, a sheet with the polyurethane added was obtained.

Removal of PVA

In the same manner as in Example 2-1, a PVA-removed sheet was obtained.

Ultra-Fining of Fibers (Removal of Sea Component)

In the same manner as in Example 2-1, a sea component-removed sheet was obtained.

Cutting in Half, Napping, Dyeing, Reduction Cleaning

In the same manner as in Example 2-1, a sheet-shaped material was obtained. The obtained sheet-shaped material had a good surface appearance, a soft texture, and good abrasion resistance.

Example 2-4

Nonwoven Fabric as Fibrous Substrate

The same nonwoven fabric as in Example 2-1 was used as a fibrous substrate.

Preparation of PVA Solution

A PVA (NM-11 produced by The Nippon Synthetic Chemical Industry Co., Ltd.) having a degree of saponification of 99% and a degree of polymerization of 1,100 was used to prepare an aqueous solution having a solid content of 10% by mass and the solution was used as a PVA solution.

Addition of PVA

The nonwoven fabric as a fibrous substrate was impregnated with the PVA solution, and heated and dried at a temperature of 140° C. for 10 minutes to give a sheet to which the PVA was attached in an amount of 15% by mass relative to the total mass of the island component in the islands-in-the-sea fibers in the nonwoven fabric.

Preparation of Polyurethane Dispersion

The same waterborne polyurethane dispersion as in Example 2-1 was used.

Addition of Polyurethane

In the same manner as in Example 2-1, a sheet with the polyurethane added was obtained.

Removal of PVA

In the same manner as in Example 2-1, a PVA-removed sheet was obtained.

Ultra-Fining of Fibers (Removal of Sea Component)

In the same manner as in Example 2-1, a sea component-removed sheet was obtained.

Cutting in Half, Napping, Dyeing, Reduction Cleaning

In the same manner as in Example 2-1, a sheet-shaped material was obtained. The obtained sheet-shaped material had a good surface appearance, a soft texture, and good abrasion resistance.

Example 2-5

Nonwoven Fabric as Fibrous Substrate

The same nonwoven fabric as in Example 2-1 was used as a fibrous substrate.

Preparation of PVA Solution

A PVA (NH-26 produced by The Nippon Synthetic Chemical Industry Co., Ltd.) having a degree of saponification of 99% and a degree of polymerization of 2,600 was used to prepare an aqueous solution having a solid content of 10% by mass and the solution was used as a PVA solution.

Addition of PVA

The nonwoven fabric as a fibrous substrate was impregnated with the PVA solution, and heated and dried at a temperature of 140° C. for 10 minutes to give a sheet to which the PVA was attached in an amount of 5% by mass relative to the total mass of the island component in the islands-in-the-sea fibers in the nonwoven fabric.

Preparation of Polyurethane Dispersion

The same waterborne polyurethane dispersion as in Example 2-1 was used.

Addition of Polyurethane

In the same manner as in Example 2-1, a sheet with the polyurethane added was obtained.

Removal of PVA

In the same manner as in Example 2-1, a PVA-removed sheet was obtained.

Ultra-Fining of Fibers (Removal of Sea Component)

In the same manner as in Example 2-1, a sea component-removed sheet was obtained.

Cutting in Half, Napping, Dyeing, Reduction Cleaning

In the same manner as in Example 2-1, a sheet-shaped material was obtained. The obtained sheet-shaped material had a good surface appearance, a soft texture, and good abrasion resistance.

Example 2-6

Nonwoven Fabric as Fibrous Substrate

The same nonwoven fabric as in Example 2-1 was used as a fibrous substrate.

Preparation of PVA Solution

The same PVA solution as in Example 2-1 was used.

Addition of PVA

The nonwoven fabric as a fibrous substrate was impregnated with the PVA solution prepared in Example 2-1, and heated and dried at a temperature of 140° C. for 10 minutes to give a sheet to which the PVA was attached in an amount of 10% by mass relative to the total mass of the island component in the nonwoven fabric.

Preparation of Polyurethane Dispersion

The same waterborne polyurethane dispersion as in Example 2-1 was used.

Addition of Polyurethane

The nonwoven fabric as a fibrous substrate with the added PVA was impregnated with the polyurethane dispersion. The fabric was treated in a wet-heat atmosphere at a temperature of 100° C. for 5 minutes, then dried with hot air at a drying temperature of 120° C. for 5 minutes, and dry-heated at a temperature of 150° C. for 2 minutes to give a sheet to which the polyurethane was attached in an amount of 30% by mass relative to the total mass of the island component in the nonwoven fabric.

Removal of PVA, Ultra-Fining of Fibers (Removal of Sea Component)

The sheet with the added polyurethane was immersed in a 10 g/L aqueous sodium hydroxide solution at 95° C. for 40 minutes for the removal of the PVA and for the removal of the sea component from the islands-in-the-sea composite fibers to give a sea component-removed sheet. The average single fiber diameter of the fibers on the surface of the sea component-removed sheet was 3 μm. Here, the removal of the PVA and of the sea component was simultaneously performed.

Cutting in Half, Napping, Dyeing, Reduction Cleaning

In the same manner as in Example 2-1, a sheet-shaped material was obtained. The obtained sheet-shaped material had a good surface appearance, a soft texture, and good abrasion resistance.

Example 2-7

Nonwoven Fabric as Fibrous Substrate

The same nonwoven fabric as in Example 2-1 was used as a fibrous substrate.

Preparation of PVA Solution

The same PVA solution as in Example 2-1 was used.

Addition of PVA

In the same manner as in Example 2-1, a sheet with the PVA added was obtained.

Preparation of Polyurethane Dispersion

Polyhexamethylene carbonate was used as a polyol and dicyclohexylmethane diisocyanate was used as an isocyanate to give a self-emulsifying polycarbonate polyurethane liquid. To the self-emulsifying polycarbonate polyurethane liquid was added 10 parts by mass of a thickener (SN-THICKENER 612 produced by San Nopco Limited) relative to 100 parts by mass of the solid content of the polyurethane liquid. Water was then added to adjust the overall polyurethane solid content to 20% by mass to give a waterborne polyurethane dispersion.

Addition of Polyurethane

The sea component-removed sheet with the added PVA was impregnated with the polyurethane dispersion. The sheet was dried with hot air at a drying temperature of 120° C. for 8 minutes, and dry-heated at a temperature of 150° C. for 2 minutes to give a sheet to which the polyurethane was attached in an amount of 30% by mass relative to the total mass of the fibers in the nonwoven fabric.

Removal of PVA

In the same manner as in Example 2-1, a PVA-removed sheet was obtained.

Ultra-Fining of Fibers (Removal of Sea Component)

The PVA-removed sheet was subjected to ultra-fining of the fibers in the same manner as in Example 2-1 for the removal of the sea component from the islands-in-the-sea composite fibers to give a sea component-removed sheet. The average single fiber diameter of the fibers on the surface of the sea component-removed sheet was 3 μm.

Cutting in Half, Napping, Dyeing, Reduction Cleaning

In the same manner as in Example 2-1, a sheet-shaped material was obtained. The obtained sheet-shaped material had a good surface appearance, a soft texture, and good abrasion resistance.

Comparative Example 2-1

Nonwoven Fabric as Fibrous Substrate

The same nonwoven fabric as in Example 2-1 was used as a fibrous substrate.

Preparation of PVA Solution

A PVA (GL-05 produced by The Nippon Synthetic Chemical Industry Co., Ltd.) having a degree of saponification of 87% and a degree of polymerization of 500 was used to prepare an aqueous solution having a solid content of 10% by mass and the solution was used as a PVA solution.

Addition of PVA

In the same manner as in Example 2-1 except that the above PVA solution was used, a sheet with the PVA added was obtained.

Preparation of Polyurethane Dispersion

The same waterborne polyurethane dispersion as in Example 2-1 was used.

Addition of Polyurethane

In the same manner as in Example 2-1, a sheet with the polyurethane added was obtained.

Removal of PVA

In the same manner as in Example 2-1, a PVA-removed sheet was obtained.

Ultra-Fining of Fibers (Removal of Sea Component)

In the same manner as in Example 2-1, a sea component-removed sheet was obtained.

Cutting in Half, Napping, Dyeing, Reduction Cleaning

In the same manner as in Example 2-1, a sheet-shaped material was obtained. On the obtained sheet-shaped material, the polyurethane was not uniformly attached due to partial dissolution of the PVA into the waterborne polyurethane dispersion. As a result, the sheet-shaped material had a poor surface appearance with poor separability of the fibers and with no dense nap and had a hard texture.

Comparative Example 2-2

Nonwoven Fabric as Fibrous Substrate

The same nonwoven fabric as in Example 2-1 was used as a fibrous substrate.

Preparation of PVA Solution

A PVA (NL-05 produced by The Nippon Synthetic Chemical Industry Co., Ltd.) having a degree of saponification of 99% and a degree of polymerization of 500 was used to prepare an aqueous solution having a solid content of 10% by mass and the solution was used as a PVA solution.

Addition of PVA

In the same manner as in Example 2-1 except that the above PVA solution was used, a sheet with the PVA added was obtained.

Preparation of Polyurethane Dispersion

The same waterborne polyurethane dispersion as in Example 2-1 was used.

Addition of Polyurethane

In the same manner as in Example 2-1, a sheet with the polyurethane added was obtained.

Removal of PVA

In the same manner as in Example 2-1, a PVA-removed sheet was obtained.

Ultra-Fining of Fibers (Removal of Sea Component)

In the same manner as in Example 2-1, a sea component-removed sheet was obtained.

Cutting in Half, Napping, Dyeing, Reduction Cleaning

In the same manner as in Example 2-1, a sheet-shaped material was obtained. On the obtained sheet-shaped material, the polyurethane was not uniformly attached due to partial dissolution of the PVA into the waterborne polyurethane dispersion. As a result, the sheet-shaped material had a poor surface appearance with poor separability of the fibers and with no dense nap and had a hard texture.

Comparative Example 2-3

Nonwoven Fabric as Fibrous Substrate

The same nonwoven fabric as in Example 2-1 was used as a fibrous substrate.

Preparation of PVA Solution

The same PVA solution as in Example 2-1 was used.

Addition of EVA

The nonwoven fabric as a fibrous substrate was processed with the same PVA solution as in Example 2-1 in the same manner as in Example 2-1 except that the amount of the PVA attached to the nonwoven fabric was adjusted by controlling the degree of wringing after the impregnation, to give a sheet to which the PVA was attached in an amount of 55% by mass relative to the total mass of the island component in the islands-in-the-sea fibers in the nonwoven fabric.

Preparation of Polyurethane Dispersion

The same waterborne polyurethane dispersion as in Example 2-1 was used.

Addition of Polyurethane

In the same manner as in Example 2-1, a sheet with the polyurethane added was obtained.

Removal of PVA

In the same manner as in Example 2-1, a PVA-removed sheet was obtained.

Ultra-Fining of Fibers (Removal of Sea Component)

In the same manner as in Example 2-1, a sea component-removed sheet was obtained.

Cutting in Half, Napping, Dyeing, Reduction Cleaning

In the same manner as in Example 2-1, a sheet-shaped material was obtained. The obtained sheet-shaped material had a soft texture. However, the excess amount of the PVA prevented the polyurethane from sufficiently gripping the fibers. As a result, the sheet-shaped material had a poor surface appearance with an excessively long nap and had poor abrasion resistance.

Comparative Example 2-4

A sheet-shaped material was produced in the same manner as in Example 2-1 except that no PVA solution was prepared and that no PVA was added or removed. The obtained sheet-shaped material had a hard texture and had a poor surface appearance without a nap.

Table 2 shows the evaluation results of the sheet-shaped materials obtained in Examples 2-1 to 2-7 and Comparative Examples 2-1 to 2-4.

TABLE 2

| Examples | Fibrous substrate: Average single fiber diameter μm | Polyvinyl alcohol (PVA): Degree of saponification % | Polyvinyl alcohol (PVA): Degree of polymerization — | Polyvinyl alcohol (PVA): Viscosity mPa · s | Polyvinyl alcohol (PVA): Tg ° C. | Polyvinyl alcohol (PVA): Melting point ° C. | Polyvinyl alcohol (PVA): Tensile strength of film kg/cm$^2$ | Amount of attached PVA % by mass | Sheet-shaped material: Sheet density g/cm$^3$ | Sheet-shaped material: Texture mm | Sheet-shaped material: Abrasion resistance mg | Sheet-shaped material: Surface appearance Grade |
|---|---|---|---|---|---|---|---|---|---|---|---|---|
| Example 2-1 | 3 | 99 | 1400 | 22 | 85 | 230 | 550 | 10 | 0.4 | 25 | 40 | 5 |
| Example 2-2 | 4.4 | 99 | 1400 | 22 | 85 | 230 | 550 | 10 | 0.45 | 28 | 35 | 5 |
| Example 2-3 | 3 | 99 | 1400 | 22 | 85 | 230 | 550 | 20 | 0.3 | 21 | 50 | 4 |
| Example 2-4 | 3 | 99 | 1100 | 14 | 80 | 210 | 480 | 15 | 0.4 | 23 | 42 | 5 |
| Example 2-5 | 3 | 99 | 2600 | 64 | 88 | 235 | 600 | 5 | 0.2 | 40 | 22 | 4 |
| Example 2-6 | 3 | 99 | 1400 | 22 | 85 | 230 | 550 | 10 | 0.4 | 30 | 50 | 4 |
| Example 2-7 | 3 | 99 | 1400 | 22 | 85 | 230 | 550 | 10 | 0.4 | 50 | 50 | 4 |
| Comparative Example 2-1 | 3 | 87 | 500 | 5 | 58 | 180 | 330 | 10 | 0.3 | 120 | 38 | 2 |
| Comparative Example 2-2 | 3 | 99 | 500 | 5 | 83 | 225 | 520 | 10 | 0.4 | 145 | 30 | 2 |
| Comparative Example 2-3 | 3 | 99 | 1400 | 22 | 85 | 230 | 550 | 55 | 0.15 | 13 | 95 | 1 |
| Comparative Example 2-4 | 3 | — | — | — | — | — | — | 0 | 0.4 | 168 | 16 | 1 |

The sheet-shaped materials obtained in Examples 2-1 to 2-7 had a good surface appearance, a soft texture, and good abrasion resistance. In contrast, most of the sheet-shaped materials obtained in Comparative Examples 2-1 to 2-4 had a poor surface appearance and a hard texture.

Example 3-1

Nonwoven Fabric as Fibrous Substrate

A polyethylene terephthalate copolymerized with 8 mol % of sodium 5-sulfoisophthalate was used as the sea component, and a polyethylene terephthalate was used as the island component. The sea and island components were used at a ratio of 45%:55% by mass to give islands-in-the-sea composite fibers with 36 islands per filament and an average single fiber diameter of 17 μm. The obtained islands-in-the-sea composite fibers were cut into a length of 51 mm to prepare staples. The staples were subjected to carding and cross lapping to form a fibrous web. The fibrous web was needle punched to give a nonwoven fabric. The thus obtained nonwoven fabric was shrunk by being immersed in hot water at a temperature of 98° C. for 2 minutes and was dried at a temperature of 100° C. for 5 minutes to give a nonwoven fabric as a fibrous substrate.

Preparation of First Polyurethane Dispersion

Polytetramethylene glycol was used as a polyol and dicyclohexylmethane diisocyanate was used as an isocyanate to give a forcibly emulsified polyether polyurethane liquid. To the forcibly emulsified polyether polyurethane liquid was added 2 parts by mass of magnesium sulfate as a heat-sensitive coagulant relative to 100 parts by mass of the solid content of the polyurethane liquid. Water was then added to adjust the overall solid content to 20% by mass to give a waterborne polyurethane dispersion. The heat-sensitive coagulation temperature was 64° C.

Addition of First Polyurethane

The nonwoven fabric as a fibrous substrate was impregnated with the first polyurethane dispersion. The fabric was treated in a wet-heat atmosphere at a temperature of 100° C. for 5 minutes, then dried with hot air at a drying temperature of 120° C. for 5 minutes, and dry-heated at a temperature of 150° C. for 2 minutes to give a sheet to which the first polyurethane was attached in an amount of 3% by mass relative to the total mass of the island component in the nonwoven fabric.

Ultra-Fining of Fibers (Removal of Sea Component)

The sheet with the added polyurethane was immersed in a 10 g/L aqueous sodium hydroxide solution at 95° C. for 30 minutes for the removal of the sea component from the islands-in-the-sea composite fibers to give a sea component-removed sheet. The average single fiber diameter of the fibers on the surface of the sea component-removed sheet was 3 μm.

Preparation of PVA Solution

A PVA (NM-14 produced by The Nippon Synthetic Chemical Industry Co., Ltd.) having a degree of saponification of 99% and a degree of polymerization of 1,400 was used to prepare an aqueous solution having a solid content of 10% by mass and the solution was used as a PVA solution.

Addition of PVA

The sea component-removed sheet was impregnated with the PVA solution, and heated and dried at a temperature of 140° C. for 10 minutes to give a sheet to which the PVA was attached in an amount of 10% by mass relative to the total mass of the fibers in the sea component-removed sheet.

Preparation of Second Polyurethane Dispersion

Polyhexamethylene carbonate was used as a polyol and dicyclohexylmethane diisocyanate was used as an isocyanate to give a self-emulsifying polycarbonate polyurethane dispersion. To the self-emulsifying polycarbonate polyurethane dispersion was added 2 parts by mass of ammonium persulfate (APS) as a heat-sensitive coagulant relative to 100 parts by mass of the solid content of the polyurethane dispersion. Water was then added to adjust the overall solid content to 20% by mass to give a waterborne polyurethane dispersion. The heat-sensitive coagulation temperature was 72° C.

Addition of Second Polyurethane

The sea component-removed sheet with the added PVA was impregnated with the second polyurethane dispersion. The sheet was treated in a wet-heat atmosphere at a temperature of 100° C. for 5 minutes, then dried with hot air at a drying temperature of 120° C. for 5 minutes, and dry-heated at a temperature of 150° C. for 2 minutes to give a sheet to which the second polyurethane was attached in an amount of 30% by mass relative to the total mass of the fibers in the nonwoven fabric.

Removal of PVA

The sheet with the added second polyurethane was immersed in hot water at 95° C. for 10 minutes to give a PVA-removed sheet.

Cutting in Half, Napping, Dyeing, Reduction Cleaning

The PVA-removed sheet was cut in half thickness-wise. The surfaces opposite to the cut surfaces were subjected to napping treatment by grinding with a 240-mesh abrasive belt. The sheet was then dyed with a disperse dye by using a circular dyeing machine and subjected to reduction cleaning to give a sheet-shaped material. The obtained sheet-shaped material had a good surface appearance, a soft texture, and good abrasion resistance.

Example 3-2

Nonwoven Fabric as Fibrous Substrate

A polyethylene terephthalate copolymerized with 8 mol % of sodium 5-sulfoisophthalate was used as the sea component, and a polyethylene terephthalate was used as the island component. The sea and island components were used at a ratio of 20%:80% by mass to give islands-in-the-sea composite fibers with 16 islands per filament and an average single fiber diameter of 30 μm. The obtained islands-in-the-sea composite fibers were cut into a length of 51 mm to prepare staples. The staples were subjected to carding and cross lapping to form a fibrous web. The fibrous web was needle punched to give a nonwoven fabric. The thus obtained nonwoven fabric was shrunk by being immersed in hot water at a temperature of 98° C. for 2 minutes and was dried at a temperature of 100° C. for 5 minutes to give a nonwoven fabric as a fibrous substrate.

Preparation of First Polyurethane Dispersion

The same first polyurethane as in Example 3-1 was used.

Addition of First Polyurethane

In the same manner as in Example 3-1, a sheet with the first polyurethane added was obtained.

Ultra-Fining of Fibers (Removal of Sea Component)

In the same manner as in Example 3-1, a sea component-removed sheet was obtained. The average single fiber diameter of the fibers on the surface of the sea component-removed sheet was 4.4 μm.

Preparation of PVA Solution

The same PVA solution as in Example 3-1 was used.

Addition of PVA

In the same manner as in Example 3-1, a sheet with the PVA added was obtained.

Preparation of Second Polyurethane Dispersion

The same second polyurethane dispersion as in Example 3-1 was used.

Addition of Second Polyurethane

In the same manner as in Example 3-1, a sheet with the second polyurethane added was obtained.

Removal of PVA

In the same manner as in Example 3-1, a PVA-removed sheet was obtained.

Cutting in Half, Napping, Dyeing, Reduction Cleaning

In the same manner as in Example 3-1, a sheet-shaped material was obtained. The obtained sheet-shaped material had a good surface appearance, a soft texture, and good abrasion resistance.

Example 3-3

Nonwoven Fabric as Fibrous Substrate

The same nonwoven fabric as in Example 3-1 was used as a fibrous substrate.

Preparation of First Polyurethane Dispersion

The same first polyurethane dispersion as in Example 3-1 was used.

Addition of First Polyurethane

In the same manner as in Example 3-1, a sheet with the first polyurethane added was obtained.

Ultra-Fining of Fibers (Removal of Sea Component)

In the same manner as in Example 3-1, a sea component-removed sheet was obtained.

Preparation of PVA Solution

A PVA (NM-11 produced by The Nippon Synthetic Chemical Industry Co., Ltd.) having a degree of saponification of 99% and a degree of polymerization of 1,100 was used to prepare an aqueous solution having a solid content of 10% by mass and the solution was used as a PVA solution.

Addition of PVA

The sea component-removed sheet was impregnated with the PVA solution, and heated and dried at a temperature of 140° C. for 10 minutes to give a sheet to which the PVA was attached in an amount of 15% by mass relative to the total mass of the fibers in the sea component-removed sheet.

Preparation of Second Polyurethane Dispersion

The same second polyurethane dispersion as in Example 3-1 was used.

Addition of Second Polyurethane

In the same manner as in Example 3-1, a sheet with the second polyurethane added was obtained.

Removal of PVA

In the same manner as in Example 3-1, a PVA-removed sheet was obtained.

Cutting in half, napping, dyeing, reduction cleaning

In the same manner as in Example 3-1, a sheet-shaped material was obtained. The obtained sheet-shaped material had a good surface appearance, a soft texture, and good abrasion resistance.

Example 3-4

Nonwoven Fabric as Fibrous Substrate

The same nonwoven fabric as in Example 3-1 was used as a fibrous substrate.

Preparation of First Polyurethane Dispersion

The same first polyurethane dispersion as in Example 3-1 was used.

Addition of First Polyurethane

In the same manner as in Example 3-1, a sheet with the first polyurethane added was obtained.

Ultra-Fining of Fibers (Removal of Sea Component)

In the same manner as in Example 3-1, a sea component-removed sheet was obtained.

Preparation of PVA Solution

A PVA (NH-26 produced by The Nippon Synthetic Chemical Industry Co., Ltd.) having a degree of saponification of 99% and a degree of polymerization of 2,600 was used to prepare an aqueous solution having a solid content of 10% by mass and the solution was used as a PVA solution.

Addition of PVA

The sea component-removed sheet was impregnated with the PVA solution, and heated and dried at a temperature of 140° C. for 10 minutes to give a sheet to which the PVA was attached in an amount of 5% by mass relative to the total mass of the fibers in the sea component-removed sheet.

Preparation of Second Polyurethane Dispersion

The same second polyurethane dispersion as in Example 3-1 was used.

Addition of Second Polyurethane

In the same manner as in Example 3-1, a sheet with the second polyurethane added was obtained.

Removal of PVA

In the same manner as in Example 3-1, a PVA-removed sheet was obtained.

Cutting in Half, Napping, Dyeing, Reduction Cleaning

In the same manner as in Example 3-1, a sheet-shaped material was obtained. The obtained sheet-shaped material had a good surface appearance, a soft texture, and good abrasion resistance.

Example 3-5

Nonwoven Fabric as Fibrous Substrate

The same nonwoven fabric as in Example 3-1 was used as a fibrous substrate.

Preparation of First Polyurethane Dispersion

The same first polyurethane dispersion as in Example 3-1 was used.

Addition of First Polyurethane

In the same manner as in Example 3-1, a sheet with the first polyurethane added was obtained.

Ultra-Fining of Fibers (Removal of Sea Component)

In the same manner as in Example 3-1, a sea component-removed sheet was obtained.

Preparation of PVA Solution

The same PVA solution as in Example 3-1 was used.

Addition of PVA

In the same manner as in Example 3-1, a sheet with the PVA added was obtained.

Preparation of Second Polyurethane Dispersion

Polyhexamethylene carbonate was used as a polyol and dicyclohexylmethane diisocyanate was used as an isocyanate to give a self-emulsifying polycarbonate polyurethane liquid. To the self-emulsifying polycarbonate polyurethane liquid was added 10 parts by mass of a thickener (SN-THICKENER 612 produced by San Nopco Limited) relative to 100 parts by mass of the solid content of the polyurethane liquid. Water was then added to adjust the overall polyurethane solid content to 20% by mass to give a waterborne polyurethane dispersion.

Addition of Second Polyurethane

The sea component-removed sheet with the added PVA was impregnated with the polyurethane dispersion. The sheet was dried with hot air at a drying temperature of 120° C. for 8 minutes, and dry-heated at a temperature of 150° C. for 2 minutes to give a sheet to which the polyurethane was attached in an amount of 30% by mass relative to the total mass of the fibers in the nonwoven fabric.

Removal of PVA

In the same manner as in Example 3-1, a PVA-removed sheet was obtained.

Cutting in Half, Napping, Dyeing, Reduction Cleaning

In the same manner as in Example 3-1, a sheet-shaped material was obtained. The obtained sheet-shaped material had a good surface appearance, a soft texture, and good abrasion resistance.

Comparative Example 3-1

Nonwoven Fabric as Fibrous Substrate

The same nonwoven fabric as in Example 3-1 was used as a fibrous substrate.

Preparation of First Polyurethane Dispersion

The same first polyurethane as in Example 3-1 was used.

Addition of First Polyurethane

In the same manner as in Example 3-1, a sheet with the first polyurethane added was obtained.

Ultra-Fining of Fibers (Removal of Sea Component)

In the same manner as in Example 3-1, a sea component-removed sheet was obtained.

Preparation of PVA Solution

A PVA (GL-05 produced by The Nippon Synthetic Chemical Industry Co., Ltd.) having a degree of saponification of 87% and a degree of polymerization of 500 was used to prepare an aqueous solution having a solid content of 10% by mass and the solution was used as a PVA solution.

Addition of PVA

The sea component-removed sheet was impregnated with the PVA solution, and heated and dried at a temperature of 140° C. for 10 minutes to give a sheet to which the PVA was attached in an amount of 10% by mass relative to the total mass of the fibers in the sea component-removed sheet.

Preparation of Second Polyurethane Dispersion

The same second polyurethane dispersion as in Example 3-1 was used.

Addition of Second Polyurethane

In the same manner as in Example 3-1, a sheet with the second polyurethane added was obtained.

Removal of PVA

In the same manner as in Example 3-1, a PVA-removed sheet was obtained.

Cutting in Half, Napping, Dyeing, Reduction Cleaning

In the same manner as in Example 3-1, a sheet-shaped material was obtained. On the obtained sheet-shaped material, the polyurethane was not uniformly attached due to partial dissolution of the PVA into the waterborne polyurethane dispersion. As a result, the sheet-shaped material had a poor surface appearance with poor separability of the fibers and with no dense nap and had a hard texture.

Comparative Example 3-2

Nonwoven Fabric as Fibrous Substrate

The same nonwoven fabric as in Example 3-1 was used as a fibrous substrate.

Preparation of First Polyurethane Dispersion

The same first polyurethane as in Example 3-1 was used.

Addition of First Polyurethane

In the same manner as in Example 3-1, a sheet with the first polyurethane added was obtained.

Ultra-Fining of Fibers (Removal of Sea Component)

In the same manner as in Example 3-1, a sea component-removed sheet was obtained.

Preparation of PVA Solution

A PVA (NL-05 produced by The Nippon Synthetic Chemical Industry Co., Ltd.) having a degree of saponification of 99% and a degree of polymerization of 500 was used to prepare an aqueous solution having a solid content of 10% by mass and the solution was used as a PVA solution.

Addition of PVA

The sea component-removed sheet was impregnated with the PVA solution, and heated and dried at a temperature of 140° C. for 10 minutes to give a sheet to which the PVA was attached in an amount of 10% by mass relative to the total mass of the fibers in the sea component-removed sheet.

Preparation of Second Polyurethane Dispersion

The same second polyurethane dispersion as in Example 3-1 was used.

Addition of Second Polyurethane

In the same manner as in Example 3-1, a sheet with the second polyurethane added was obtained.

Removal of PVA

In the same manner as in Example 3-1, a PVA-removed sheet was obtained.

Cutting in Half, Napping, Dyeing, Reduction Cleaning

In the same manner as in Example 3-1, a sheet-shaped material was obtained. On the obtained sheet-shaped material, the polyurethane was not uniformly attached due to partial dissolution of the PVA into the waterborne polyurethane dispersion. As a result, the sheet-shaped material had a poor surface appearance with poor separability of the fibers and no dense nap and had a hard texture.

Comparative Example 3-3

Nonwoven Fabric as Fibrous Substrate

The same nonwoven fabric as in Example 3-1 was used as a fibrous substrate.

Preparation of First Polyurethane Dispersion

The same first polyurethane as in Example 3-1 was used.

Addition of First Polyurethane

In the same manner as in Example 3-1, a sheet with the first polyurethane added was obtained.

Ultra-Fining of Fibers (Removal of Sea Component)

In the same manner as in Example 3-1, a sea component-removed sheet was obtained.

Preparation of PVA Solution

The same PVA solution as in Example 3-1 was used.

Addition of PVA

The sea component-removed sheet was processed with the same PVA solution as in Example 3-1 in the same manner as in Example 3-1 except that the amount of the PVA attached to the sea component-removed sheet was adjusted by controlling the degree of wringing after the impregnation, to give a sheet to which the PVA was attached in an amount of 55% by mass relative to the total mass of the fibers in the sea component-removed sheet.

Preparation of Second Polyurethane Dispersion

The same second polyurethane dispersion as in Example 3-1 was used.

Addition of Second Polyurethane

In the same manner as in Example 3-1, a sheet with the second polyurethane added was obtained.

Removal of PVA

In the same manner as in Example 3-1, a PVA-removed sheet was obtained.

Cutting in Half, Napping, Dyeing, Reduction Cleaning

In the same manner as in Example 3-1, a sheet-shaped material was obtained. The obtained sheet-shaped material had a soft texture. However, the excess amount of the PVA prevented the polyurethane from sufficiently gripping the fibers. As a result, the sheet-shaped material had a poor surface appearance with an excessively long nap and had poor abrasion resistance.

Comparative Example 3-4

A sheet-shaped material was produced in the same manner as in Example 3-1 except that no PVA solution was prepared and that no PVA was added or removed. The obtained sheet-shaped material had a hard texture and had a poor surface appearance without a nap.

Table 3 shows the evaluation results of the sheet-shaped materials obtained in Examples 3-1 to 3-5 and Comparative Examples 3-1 to 3-4.

TABLE 3

| | Fibrous substrate | Polyvinyl alcohol (PVA) | | | | | | Amount of | Sheet-shaped material | | | |
|---|---|---|---|---|---|---|---|---|---|---|---|---|
| Examples | Average single fiber diameter μm | Degree of saponification % | Degree of polymerization — | Viscosity mPa · s | Tg ° C. | Melting point ° C. | Tensile strength of film kg/cm$^2$ | attached PVA % by mass | Sheet density g/cm$^3$ | Texture mm | Abrasion resistance mg | Surface appearance Grade |
| Example 3-1 | 3 | 99 | 1400 | 22 | 85 | 230 | 550 | 10 | 0.4 | 80 | 12 | 4 |
| Example 3-2 | 4.4 | 99 | 1400 | 22 | 85 | 230 | 550 | 10 | 0.5 | 100 | 8 | 4 |
| Example 3-3 | 3 | 99 | 1100 | 14 | 80 | 210 | 480 | 15 | 0.4 | 51 | 16 | 5 |
| Example 3-4 | 3 | 99 | 2600 | 64 | 88 | 235 | 600 | 5 | 0.2 | 80 | 10 | 4 |
| Example 3-5 | 3 | 99 | 1400 | 22 | 85 | 230 | 550 | 10 | 0.4 | 85 | 25 | 4 |
| Comparative Example 3-1 | 3 | 87 | 500 | 5 | 58 | 180 | 330 | 10 | 0.3 | 166 | 32 | 2 |
| Comparative Example 3-2 | 3 | 99 | 500 | 5 | 83 | 225 | 520 | 10 | 0.4 | 180 | 26 | 2 |
| Comparative Example 3-3 | 3 | 99 | 1400 | 22 | 85 | 230 | 550 | 55 | 0.15 | 32 | 80 | 1 |
| Comparative Example 3-4 | 3 | — | — | — | — | — | — | 0 | 0.4 | 240 | 10 | 1 |

The sheet-shaped materials obtained in Examples 3-1 to 3-5 had a good surface appearance, a soft texture, and good abrasion resistance. In contrast, most of the sheet-shaped materials obtained in Comparative Examples 3-1 to 3-4 had a poor surface appearance and a hard texture.

The sheet-shaped material obtained according to the present invention is suitable as interior materials having a very elegant appearance, such as surface materials of furniture, chairs, walls, seats in vehicles including automobiles, trains, and aircrafts, ceiling, and interior decoration; clothing materials, such as shirts, jackets, upper and trim and the like of shoes including casual shoes, sports shoes, men's shoes and ladies' shoes, bags, belts, wallets, and a part of them; and industrial materials such as wiping cloth, abrasive cloth and CD curtains.

The invention claimed is:

1. A process for producing a sheet-shaped material, the process comprising the steps of:

(a) adding a polyvinyl alcohol to a fibrous substrate, by impregnating the fibrous substrate with an aqueous polyvinyl alcohol solution, wherein the polyvinyl alcohol has a degree of saponification of 98% or more, a degree of polymerization of 1400 to 3,500 and a tensile strength of 400 to 800 kg/cm$^2$, and wherein the amount of polyvinyl alcohol added to the fibrous substrate is in an amount of 0.1 to 50% by mass relative to the total mass of fibers in the fibrous substrate;

(b) adding a waterborne polyurethane to the fibrous substrate with the added polyvinyl alcohol;

(c) removing the polyvinyl alcohol from the fibrous substrate with the added waterborne polyurethane; and (d) generating microfibers, wherein the step (a), the step (b) and the step (c) are conducted in this order, and wherein the step (d) is performed before the step (a), or the step (d) is performed after the step (c), or the step (c) and the step (d) are concurrently performed.

2. The process for producing a sheet-shaped material according to claim 1, wherein the fibrous substrate in the steps (a), (b), (c) and (d) comprises, as its main constituent, microfibers, and wherein the step (d) of generating the microfibers, having an average single fiber diameter of 0.3 to 7 μm, from the microfiber-generating fibers is performed before adding the polyvinyl alcohol in the step (a).

3. The process for producing a sheet-shaped material according to claim 2, wherein the step of generating the microfibers is performed by treatment with an aqueous alkali solution.

4. The process for producing a sheet-shaped material according to any one of claims 1 to 3, wherein the fibrous substrate in the steps (a), (b) and (c) comprises, as its main constituent, microfibers having an average single fiber diameter of 0.3 to 7 μm, and wherein, before the step (a), the steps of adding a waterborne polyurethane to a fibrous substrate comprising microfiber-generating fibers as its main constituent and of generating the microfibers from the microfiber-generating fibers in the fibrous substrate with the added waterborne polyurethane are performed.

5. The process for producing a sheet-shaped material according to any one of claims 1 to 3, wherein the fibrous substrate in the steps (a), (b) and (c) comprises microfiber-generating fibers as its main constituent, and wherein, after or concurrently with the step (c), the step of generating microfibers having an average single fiber diameter of 0.3 to 7 μm from the microfiber-generating fibers contained in the fibrous substrate as its main constituent.

6. The process for producing a sheet-shaped material according to any one of claims 1 to 3, wherein the fibrous substrate is prepared by entangling microfibers having an average single fiber diameter of 0.3 to 7 μm or microfiber-generating fibers with a woven fabric and/or a knitted fabric so as to be integrated together.

7. A sheet-shaped material obtained by the production process according to any one of claims 1 to 3, the sheet-shaped material having a density of 0.2 to 0.7 g/cm$^3$.

8. The process for producing a sheet-shaped material according to claim 1, wherein the fibrous substrate in the steps (a), (b), (c) and (d) comprises, as its main constituent, the microfiber-generating fibers, and wherein the step (d) of generating the microfibers, having an average single fiber diameter of 0.3 to 7 μm, from the microfiber-generating fibers is performed after removing the polyvinyl alcohol in the step (c).

9. The process for producing a sheet-shaped material according to claim 1, wherein the fibrous substrate in the steps (a), (b), (c) and (d) comprises, as its main constituent, the microfiber-generating fibers, and wherein the step (d) of generating the microfibers, having an average single fiber diameter of 0.3 to 7 μm, from the microfiber-generating fibers is performed concurrently with removing the polyvinyl alcohol in the step (c) following adding the waterborne polyurethane in the step (b).

10. The process for producing a sheet-shaped material according to claim 8 or 9, wherein the step of generating the microfibers is performed by treatment with an aqueous alkali solution.

11. The process for producing a sheet-shaped material according to claim 8 or 9, wherein the fibrous substrate is prepared by entangling microfibers having an average single fiber diameter of 0.3 to 7 μm or microfiber-generating fibers with a woven fabric and/or a knitted fabric so as to be integrated together.

12. A sheet-shaped material obtained by the production process according to claim 8 or 9, the sheet-shaped material having a density of 0.2 to 0.7 g/cm$^3$.

* * * * *